US011648177B2

(12) United States Patent
Bois et al.

(10) Patent No.: US 11,648,177 B2
(45) Date of Patent: May 16, 2023

(54) CONTAINER FOR MEDICAL AND/OR PHARMACEUTICAL PRODUCTS WITH INTERSTICE

(71) Applicant: AIRNOV, Inc., Wilmington, DE (US)

(72) Inventors: Dominique Bois, Montreuil aux Lions (FR); Valere Logel, Levallois Perret (FR)

(73) Assignee: AIRNOV, INC., Wilmington, DE (US)

( * ) Notice: Subject to any disclaimer, the term of this patent is extended or adjusted under 35 U.S.C. 154(b) by 308 days.

(21) Appl. No.: 16/959,382

(22) PCT Filed: Dec. 29, 2018

(86) PCT No.: PCT/EP2018/097146
§ 371 (c)(1),
(2) Date: Jun. 30, 2020

(87) PCT Pub. No.: WO2019/129889
PCT Pub. Date: Jul. 4, 2019

(65) Prior Publication Data

US 2021/0059902 A1 Mar. 4, 2021

(30) Foreign Application Priority Data

Dec. 30, 2017 (FR) ..... 1763426

(51) Int. Cl.
*A61J 1/14* (2006.01)
*A61J 1/03* (2006.01)
(Continued)

(52) U.S. Cl.
CPC ..... *A61J 1/1468* (2015.05); *A61J 1/03* (2013.01); *A61J 1/1425* (2015.05);
(Continued)

(58) Field of Classification Search
CPC .. B65D 81/264; B65D 81/266; B65D 81/267; B65D 77/0493; B65D 81/26; A61J 1/03; A61J 1/1425; A61J 1/1468
See application file for complete search history.

(56) References Cited

U.S. PATENT DOCUMENTS 8,875,917 B2 11/2014 Lourenco et al.
9,428,311 B2 * 8/2016 Bois ..... B65D 43/169
2007/0193891 A1 * 8/2007 Portier ..... B65D 79/02 206/459.1
(Continued)

FOREIGN PATENT DOCUMENTS

EP 0454967 A2 11/1991
EP 2966000 A1 * 1/2016 ..... A61J 1/03
(Continued)

OTHER PUBLICATIONS

PCT/EP2018/097146 International Search Report and Written Opinion dated Mar. 8, 2019, 3 pages.
(Continued)

*Primary Examiner* — Rafael A Ortiz
(74) *Attorney, Agent, or Firm* — Haynes Beffel & Wolfeld LLP; Andrew L. Dunlap

(57) ABSTRACT

The invention pertains to a container for storing medical and/or pharmaceutical products. The container includes a plastic container body including a side wall, a base and an opening defining the storage volume, an active insert, placed inside the container body and including a tubular side wall of length L, extending from a lower extremity to an upper extremity, and an empty interstice between the side wall of the active insert and the side wall of the container body. This container is an improved container for the storage of medical and/or pharmaceutical products.

20 Claims, 10 Drawing Sheets

(51) Int. Cl.
*B65D 77/04* (2006.01)
*B65D 81/26* (2006.01)

(52) U.S. Cl.
CPC ..... *B65D 77/0493* (2013.01); *B65D 81/264* (2013.01); *B65D 81/266* (2013.01)

(56) References Cited

U.S. PATENT DOCUMENTS

| | | | | |
|---|---|---|---|---|
| 2009/0194904 | A1* | 8/2009 | Logel | B65D 81/266 264/250 |
| 2011/0000930 | A1* | 1/2011 | Logel | B65D 43/169 220/849 |
| 2011/0056951 | A1* | 3/2011 | Wooldridge | B65D 81/267 220/495.01 |
| 2012/0193246 | A1 | 8/2012 | Chang | |
| 2013/0256329 | A1* | 10/2013 | Belfance | B65D 43/162 156/69 |
| 2013/0334074 | A1* | 12/2013 | Wada | B65D 81/26 206/204 |
| 2016/0030286 | A1 | 2/2016 | Fazi et al. | |
| 2016/0031627 | A1* | 2/2016 | Yeh | B65D 81/266 206/204 |

FOREIGN PATENT DOCUMENTS

| | | | | |
|---|---|---|---|---|
| EP | 2966000 | A1 | 1/2016 | |
| JP | 2004136933 | A | 5/2004 | |
| JP | 2005059865 | A | 3/2005 | |
| WO | 2017139446 | A1 | 8/2017 | |
| WO | WO-2017139446 | A1 * | 8/2017 | B65D 43/162 |

OTHER PUBLICATIONS

PCT/EP2018/097146—International Preliminary Report on Patentability, dated Jun. 30, 2020, 6 pages.

* cited by examiner

CONTAINER FOR MEDICAL AND/OR PHARMACEUTICAL PRODUCTS WITH INTERSTICE

CROSS-REFERENCE

This application is the U.S. National Stage of International Application No. PCT/EP2018/097146, filed 29 Dec. 2018, which claims priority to French Application No. FR17/63426, filed 30 Dec. 2017.

FIELD OF THE INVENTION

The present invention pertains to a container for storing medical and/or pharmaceutical products and a method of manufacturing this container.

TECHNICAL BACKGROUND

Many products sensitive to moisture must be transported and stored in conditions as free of moisture as possible. For example, medicinal products or test strips often lose some of their efficacy after prolonged exposure to moisture and should preferably be shipped and stored in moisture-free environments. The containers for such products can be made from a moisture-proof material, such as well-known thermoplastics, which are resistant to the entry of external moisture. However, the entry of moisture into these containers is inevitable, either by diffusion or by opening and closing the container, thus exposing the product to moisture. In fact, the moisture originates from the external environment and can, for example, enter the interior of the container when it is filled with the products to be stored but also during its storage by permeability (diffusion) through the walls of the container or via the seal between the container and its cap or during its use by the consumer through the repeated opening and closing of the container.

To mitigate this entry of moisture, one solution consists of incorporating into the internal packaging environment an active agent such as a desiccant, for example silica gel, calcium chloride, a molecular sieve, other drying agents or any mixture thereof. These active agents allow moisture to be removed from the interior of the container body to preserve the stored moisture-sensitive products and increase the duration of storage ("shelf life") of the products contained inside the packaging.

One way of achieving this objective is to incorporate a drying housing to receive a desiccant in the cap of the container, for example as described in document U.S. Pat. No. 8,875,917.

Another way of achieving this objective is to incorporate into the container an active material formed by mixing an active agent directly into a structure in polymer material. However, a problem inherent in these structures is that once the active substance has been mixed into the polymer material, contact between the active substance and the moisture outside the active material is limited.

Document EP 0454967 describes a container which receives bulk stored products such as pills, tablets or capsules, particularly effervescent tablets. It is composed of a container body, closed with a cap. The container body is covered on its inner surface by a layer of desiccant material. The desiccant layer is created by mixing into a plastic such as PS, PE or PP a desiccant in granular form, so that the desiccant particles are bonded but not completely covered with plastic material, leaving a substantial part of their active surface turned towards the inner space of the container.

However, the quantity of active substance that it is freely accessible at the surface of such a desiccant material is by its nature limited.

US 2012/193246 describes a vial in which an active insert is fixed to the container body via an intermediate "non active" part. A gap is provided between the container body and the assembly of the active insert with the intermediate part.

US 2011/056951 describes a corrugated active insert placed within a container body.

JP 2004-136933 describes a container comprising an active insert having vertical sharped knurls on the sidewall and ribs on the bottom.

WO 2017/139446 describes a container having an active insert with vertical ribs on the sidewall coming into contact with the inner side wall of the container body. Ribs or holes are also provided on the bottom of the active insert.

In this context, there is a need to provide an improved container for storing medical and/or pharmaceutical products sensitive to moisture and/or other gaseous substances, such as oxygen or volatile organic compounds. In particular, there is a need to provide an improved, reliable, easy to handle, economical container, maximizing the storage space and the overall absorption capacity for treating the atmosphere inside the container, and allowing the rapid absorption of moisture and/or gaseous substances entering the container, including during cycles of opening/closing the container.

SUMMARY OF THE INVENTION

Therefore, a container for the packaging of sensitive products, such as medical and/or pharmaceutical products, as described in the claims is proposed.

The container comprises a plastic container body. The container body includes a side wall, a base and an opening defining a storage volume. The container also includes an active insert within the container body which includes a side wall. The active insert extends from a lower extremity to an upper extremity and has a noted length L. The container also contains an empty interstice, between the side wall of the active insert and the side wall of the container body.

The side wall of the container body has a generally tubular shape. The side wall of the active insert also has a generally tubular shape. The tubular shapes can extend along the same central vertical axis. A tubular shape means the shape of a tube with a circular or non-circular base. For example, the base may be a disc, an oval, a square, a rectangle, a regular or non-regular polygon, or a combination of planar surfaces and/or curved surfaces. Moreover, the diameter and/or thickness of the tubular wall may vary at least partially along the length of the tubular wall of the container body.

Empty interstice means a space free of material. The empty interstice allows better circulation of air, moisture or other gaseous substances between the active insert and the container body.

The empty interstice extends over at least 50%, preferably at least 80%, of the outer surface of the side wall of the active insert. In examples, at least 50%, preferably at least 80% of the outer surface of the side wall of the active insert is exposed to the air which can freely circulate between the active insert and the container body.

Indeed, gaseous substances and moisture in the air contained in the storage volume can easily interact with the active agent dispersed on the inner surface of the active insert, this surface being directly accessible from the storage volume. But gaseous substances can take much longer to penetrate and cross the material of the active insert in order to be able to interact with the active agent dispersed inside the material or present on the outer surface of the insert that is in contact with the wall of the container body. This results in a loss of absorption kinetics over time, although the absorption capacity of the active insert is still sufficient to absorb moisture of gaseous substances. Therefore, the exposure time of products sensitive to gaseous substances can be damaging to the quality of these stored products. The empty interstice can for example present a total volume of more than 50 μL, preferably more than 75 μL.

Inventors have found that absorption properties are improved with an active insert presenting a $V_m/S_e$ ratio ≤0.75, where $V_m$ is the total volume of material of the active insert in $mm^3$, and $S_e$ is the total surface area of the active insert in $mm^2$.

$V_m$ represents the volume actually occupied by the material of the active insert, in other words the quantity of material of the active insert. Thus, does not include the volume of the inner space (or storage space) of the active insert, i.e. the space delimited by the side wall and base of the active insert and allowing the storage of medical and/or pharmaceutical products.

$S_e$ represents the total surface area of all surfaces of the active insert. $S_e$ thus represents the complete potential exchange surface area of the active insert with its environment ($S_e$=internal surface area of the active insert $S_{int}$+ external surface area of the active insert $S_{ext}$).

In examples, the active insert may present a $V_m/S_{exp}$ ratio ≤0.75, where $V_m$ is the total volume of material of the active insert in $mm^3$ and $S_{exp}$ is the total exposed surface area of the active insert in $mm^2$. In other words, $S_{exp}=S_{insert}-S_{contact}$ where $S_{insert}$ is the total surface area of all outer surfaces of the active insert whether they are in contact with another surface or freely exposed and $S_{contact}$ is the total contact surface between the active insert and the container body (i.e. the surface of the insert that not directly in contact with the surrounding environment because it is in direct contact with the container body). Inventors have found that such a ratio yet improves absorption properties.

The presence of the empty interstice on a large proportion of the external surface of the side wall of the insert may allow to increase $S_e$.

Tests have shown particular advantageous absorption kinetics for active inserts whose dimension characteristics satisfy a $V_m/S_e$ ratio ≤0.75 (e.g. a $V_m/S_{exp}$ ratio ≤0.75). These characteristics combined with the empty interstice allow optimisation of the surface area for interaction (or exchange) between gaseous substances and the active agent within the material of the active insert and the circulation of gaseous substances along its internal surface area and its external surface area. The container thus enables in these examples an improved action of the active insert in terms of kinetics.

In order to increase the absorption capacity still more, one can furthermore in these examples seek to maximise $V_m$ while maintaining a minimum wall thickness so that $V_m/S_e$ respects the equation:

$$0.2 \leq V_m/S_e \leq 0.75$$

This ratio $0.2 \leq V_m/S_e \leq 0.75$ can in particular be applied to the side walls of the active insert (in other words, the side walls respect this ratio). This allows the aforementioned side walls of the active insert to satisfy the requirements of rapid absorption of the gaseous substance but also to incorporate a sufficient quantity of active material to ensure a sufficient absorption capacity. Preferably, $0.2 \leq V_m/S_{exp} \leq 0.75$ or $0.5 \leq V_m/S_{exp} \leq 0.75$.

Preferably, $V_m > 3\ mm^3$, more preferably $V_m > 4\ mm^3$.

In order to maximize $V_m$ and consequently the absorption capacity, the empty interstice may be as small as possible while allowing sufficient circulation of gaseous substances and interaction with the exposed surface $S_e$. The empty interstice may be less than 0.5 mm, preferably less than 0.3 mm. Indeed, Inventors have found that such a small interstice is sufficient to achieve optimal absorption properties.

In all these examples, the active insert can have such dimensions that for a predefined portion representing at least 50% of the total surface area $S_e$ (in examples, at least 50% of the total exposed surface area $S_{exp}$) of the active insert (for example the entirety of the side walls of the active insert, or indeed the entirety of the active insert), the thickness of the active insert is less than $5*V_m/S_e$ (in examples less than $5*V_m/S_{exp}$) throughout, preferably $4*V_m/S_e$ (in examples less than $4*V_m/S_{exp}$). In other words, the local thickness of the active insert does not exceed this upper limit at any point of the aforementioned predefined portion. This avoids excessive accumulations of thickness and thus optimises the action of the active insert. In examples, the predefined portion can have a thickness of more than 0.2 mm or 0.25 mm, and/or less than 3.75 mm, for example of the order of 0.6 to 2.5 mm, preferably 0.7 mm to 1.8 mm, more preferably 0.7 mm to 1.5 mm.

The active insert comprises an active ingredient capable of acting on the atmosphere of the container's storage volume. In other words, the active ingredient is capable of acting on gaseous substances present in the container's storage volume. The action makes it possible to maintain the quality of the sensitive products during their storage, for example maintaining the physical and/or chemical integrity as much as possible and/or as long as possible, in particular by protecting the products against gaseous substances likely to impair their integrity and/or their properties.

The active insert is preferably formed of a material comprising at least one polymer and at least one active agent capable of interacting with, for example trapping and/or releasing one or more gaseous substance(s), such as, for example, moisture, oxygen and/or a volatile organic compound. Preferably, the active insert is formed of a material comprising at least one polymer and at least one active agent capable of trapping one or more gaseous substance(s) such as, for example, moisture, oxygen and/or a volatile organic compound.

The container can furthermore contain a cap allowing to close the opening of the container body. The cap is preferably hinged, i.e. it is connected to the container body via a hinge. The container body and the cap are configured to form an air- and moisture-tight seal when the cap doses the opening of the container.

The container can furthermore comprise medical and/or pharmaceutical products (including for example diagnostic products) stored in the storage volume. The container and/or the hinged cap can be configured to allow the distribution of the products, for example by including a flow limiter or a distribution device by unit.

Medical and/or pharmaceutical products may comprise any product having a medical and/or pharmaceutical function. This may include products such as test strips, medicines, dietary supplements, pills, tablets, capsules, granules and powders. The container and/or cap, preferably hinged, can be configured to meet the air-tightness and protective requirements for this medical and/or pharmaceutical function when the container is closed with the cap. Likewise, the plastic material of the container body may be compatible with such a medical and/or pharmaceutical function.

In this description, the terms "upper", "lower" and "axial" refer to the vertical direction when the container is resting on its base. A wall is described as "side" or "lateral" when the wall is parallel and staggered in relation to the central vertical axis.

The container may further comprise any combination of the following features:

- The side wall of the container body has a generally tubular shape.
- The container body is injection moulded.
- The plastic material of the container body has a low permeability to moisture and/or oxygen, preferably to moisture. The plastics material may be chosen from polyolefins (polyethylene, polypropylene), polyesters, polycarbonate, cycloolefin, preferably polyolefin, in particular polypropylene and/or polyethylene.
- The active insert comprises a base axially spaced from its upper extremity. The base increases the exchange surface area.
- The active insert is moulded separately from the container body and is then assembled inside the container body, for example by pushing the active insert into the container body or by pushing the container body on the active insert.
- The side wall of the active insert goes along at least part of the side wall of the container body.
- The side wall of the active insert is substantially parallel to (i.e. equidistant from) the side wall of the container body over 50% of the surface area of the active insert, preferably 80% of its surface area.
- The empty interstice may be surrounding. In other words, it may extend all around the periphery of the sidewall of the active insert (regardless of the general shape of the side wall, which can have a circular base or not). The empty interstice may be "Surrounding" in any cross-section perpendicular to the axial direction, in which the outer surface of the active insert is not in contact with the inner surface of the container body. In other words, the air can circulate along the outer periphery of the insert in a direction perpendicular to the axial direction. Such a surrounding empty interstice may preferably extend over at least 50%, more preferably at least 80% of the length L of the side wall of the active insert. Preferably, in a cross-section perpendicular to the axial direction, the empty interstice can have a substantially constant thickness (in examples, the inner surface or the container body and the outer surface of the active insert are substantially coaxial). Preferably, the empty interstice may extend over at least 50%, more preferably at least 80% of the length L of the side wall of the active insert is continuous between two holding portions provided at the upper end and bottom end of the active insert (in other words, there is no contact between the outer surface of the active insert and the inner surface of the container body with exception to the only holding portions).
- The empty interstice between the side wall of the active insert and the side wall of the container body can be slightly conical (surrounding the side wall of the insert) increasing from 0 mm (contact condition) at upper end of the sidewall of the desiccant insert to 0.5 mm, preferably 0.3 mm at the bottom end of the desiccant insert. This further facilitates high-speed insertion of the insert into the container body. This empty space preferably extends over at least 50% of the surface area of the active insert, preferably at least 80% of its surface area.
- For a container body having an internal volume of 10 to 25 $cm^3$ (with an external diameter of 25 to 35 mm), the empty interstice can present a total volume of more than 50 μL, preferably more than 75 μL.
- The active insert is mounted concentrically in the container body.
- The active insert is formed of an active material comprising at least one polymer and at least one active agent capable of interacting with one or more gaseous substance(s), such as, for example, moisture, oxygen, a volatile organic compound and/or odours. More specifically, the active agent is capable of interacting with, for example trapping and/or releasing one or more of these gaseous substances. Preferably, the active insert is formed of a material comprising at least one polymer and at least one active agent capable of trapping one or more gaseous substance(s) such as, for example, moisture, oxygen and/or a volatile organic compound.
- The active agent is a desiccant and/or an oxygen scavenger.
- The desiccant is selected from silica gel, deliquescent salts (such as for example calcium chloride, aluminium chloride, lithium chloride, calcium bromide, zinc chloride, etc.), calcium oxide, barium oxide, clay, molecular sieve, zeolites or any combination thereof.
- The oxygen scavenger is selected from metallic powders or metallic oxides having a reducing capacity (such as for example zinc-, tin- or iron-based oxygen scavengers), ascorbic acid, polymer-based oxygen scavengers, or any combination thereof.
- The active material includes at least one polymer in which the active agent is dispersed. The polymer may be, for example, a thermosetting or a thermoplastic, preferably a thermoplastic polymer.
- The polymer is preferably substantially permeable to the gaseous substance interacting with the active agent. It may be chosen as a function of its transmission rate for the gaseous substance under consideration.
- The polymer is selected from polyolefin-based polymers (for example polyethylene, HDPE, LDPE, polypropylene (PP), Polyolefin Elastomers (POE), Biaxially oriented polypropylene (OPP)) or polystyrene (PS), polyvinyl chloride (PVC), ethylene vinyl acetate (EVA), ethylene-vinyl acetate copolymer (EVOH), a cyclic olefin copolymer (COC); polymers based on polyesters, for example polycaprolactone (PCD), polylactic acid (PLA), polyethylene terephthalate (PET), polybutylene terephthalate (PBT), polycarbonate (PC), polyoxymethylene (POM), polyimide (PA), or cellulose or a mixtures thereof.
- The active insert may be integrally formed. Preferably, the active insert may be formed in a single molded piece.
- The active insert may be substantially homogeneous. In other words, the active agent may be quite equally distributed in the polymer material. In a preferred embodiment, the concentration of active agent shall not vary by more than +/−5% all across the desiccant insert.
- In another embodiment, a structure with a concentration gradient as described by U.S. Pat. No. 7,201,959 can be created such as the concentration of active material can be greater near the surface than in the inner region of the active insert.

The active insert may be in contact, at the same time, with the storage volume on the one hand and with the empty interstice on the other hand.

The empty interstice can for example include a (e.g. essentially) tubular space between the side walk of the active insert and of the container body. In other words, a tubular or "ring" space extends around the outer surface of the side wall of the insert (regardless of the general tubular shape of the side wall, which can have a circular base or not). This empty annular space can be continuous around the entire circumference of the active insert or it can be locally interrupted by the presence of contact points between the outer surface of the active insert and the inner surface of the tube body, for example by means of longitudinal and/or discontinuous ribs extending vertically or peripherally along the outer surface of the tube.

The empty interstice includes preferably a continuous, essentially tubular space extending along the periphery of at least 50%, preferably at least 80% of the length L of the insert. In other words, the tubular space extends along the periphery of the active insert on at least 80% of the outer surface of the side wall of the active insert. That is to say, on at least 50%, preferably 80%, of the length of the insert, there is no contact between the active insert and the container body. This has an advantage as the air can more efficiently circulate all around the outer surface of the active insert while the active insert remains maintained. More preferably, this tubular space has a thickness of at least 0.02 mm on at least 50%, preferably 80% of the length L of the insert.

The empty interstice can include a space formed by a cut or a reduction in thickness on the outer surface of the side wall of the insert and/or on the inner surface of the side wall of the container body. This can for example consist of a peripheral or ring groove (i.e. extending over the entire periphery of the side wall of the insert and/or of the container body) or an axial notch. Preferably, the cut extends along at least part of the length L of the side wall of the active insert. The cut forms a passage that allows gaseous substances present in the storage volume to circulate better along the outer surface of the insert in order to interact in particular more easily and rapidly with the active agent present on the outer surface of the active insert.

The empty interstice extends along at least part of the outer surface of the base of the active insert, preferably substantially over the entire outer surface of the base of the active insert.

The thickness of the empty interstice is preferably at least 0.02 mm, more preferably at least 0.05 mm, even more preferably at least 0.1 mm. The thickness of the interstice represents the distance between the outer surface of the active insert and the inner surface of the container body, measured perpendicular to the outer surface of the insert. Preferably the empty interstice extends over at least 50% of length L of the active insert, preferably at least 80% of the length L. The thickness can be defined as the distance between the inner surface of the side wall and the surface at the same height when the active insert is in place in the container body (in a section plan horizontal or perpendicular to the axial direction of the insert), i.e. measured perpendicular to the surface of the insert.

The thickness of the empty interstice is preferably at most 0.5 mm, preferably at most 0.3 mm. This allows to maximize the storage space of the active insert (maximum internal volume) while the air can sufficiently circulate around the outer surface of active insert. Over at least 50% of length L of the active insert, preferably at least 80% of the length L, in any section plane horizontal or perpendicular to the axial direction of the insert, the empty interstice is of substantially constant thickness, preferably less than 0.5 mm; more preferably less than 0.3 mm. In other terms, the outer surface of the insert is substantially coaxial with the inner surface of the container sidewall. This allows to maximize the storage space of the active insert (maximum internal volume) while the air can sufficiently circulate around the outer surface of active insert.

The active insert can furthermore include perforations on its side wall and/or on its base. These perforations facilitate the circulation of air and increase the absorption kinetics of the active insert.

The inner surface of the container body has a holding portion configured to hold the active insert within the container body. In this way, once the insert has been assembled inside the container body, it cannot be dislodged easily from it. Keeping the insert inside the container body can be achieved in different ways:

The holding portion on the inner surface of the container body can interact with a holding portion of the active insert.

The holding portion can be located on the side wall of the container body and interact with at least part of the side wall of the active insert. It can be:

- a surface on the inner surface of the side wall of the container body that holds the active insert by pressure or clamping of at least part of the side wall of the active insert. The active insert is then in permanent contact with the inner wall of the container body and held immobile;
- a stop that, once the active insert has been fully mounted inside the container body, prevents any axial/vertical displacement of the active insert beyond this stop. For example, the active insert is placed under this stop and comes into contact with it when it is slightly displaced vertically.

When the active insert is held by pressure or clamping on the portion of the inner surface of the side wall of the container body, the contact between the active insert and the side wall of the container body is preferably not airtight. In this way, gaseous substances can circulate more easily between the side wall of the insert and the side wall of the container body. For example, the side wall of the insert and/or the side wall of the container body can have one or more notches at the level of the clamping area. The notches thus form passages where air and gaseous substances can circulate. By another method, the side wall of the insert and/or the side wall of the container body can have several longitudinal ribs distributed around the periphery. In other words, the side wall of the insert and/or the side wall of the container body can have several linear ribs in a direction parallel to the central vertical axis and distributed around the central vertical axis. The ribs thus allow the insert to be held by clamping (e.g. friction) while the empty space between each rib allows air and gaseous substances to circulate along the outer side wall of the insert. Preferably such ribs extend along less than 50%, preferably less than 20% of the length L of the active insert. In other words, there is no contact between the insert and the container body on at least 50%, preferably at least 80% of the length of the active insert.

Preferably such ribs are provided at the lower extremity of the side wall of the insert and/or the side wall of the container body, more preferably on the sidewall of the container body. Preferably, in a horizontal cross-section (perpendicular to the side walls) the ribs are V-shaped or terminated with an end radius to further limit the contact surface between the insert and the container body.

The active insert can be held by pressure, gripping or clamping of its upper extremity. The upper extremity of the active insert is in contact, preferably not airtight, with the inner surface of the container body. The contact between the upper extremity of the active insert and the inner surface of the container body may have a vertical extension of less than 1 mm, preferably less than 0.5 mm, more preferably less than 0.2 mm. This can be a contact of the edge-surface type. This type of contact is less able to form a barrier to the transit of moisture or other gaseous substances. This contact can be continuous (i.e. all around the periphery of the upper extremity of the active insert) or discontinuous. For example, the outer surface of the upper extremity of the insert and/or the portion of the side wall of the container body adjacent to the upper extremity of the insert can be provided with a groove or several grooves or cuts.

The holding portion can include a peripheral recess (or groove) and/or a protrusion on the inner surface of the side wall of the container body.

When the holding portion includes a protrusion, the latter extends inwards from the side wall of the container body. This protrusion can be:

peripheral; continuous or discontinuous. For example, it can include one or more notches arranged along this protrusion. The notches form passages that allow better circulation of air from the storage volume towards the empty interstice between the active insert and the container body;

located above the upper extremity of the active insert. Thus, once the active insert has been mounted inside the container body, the protrusion prevents disassembly of the active insert by interaction between the protrusion and the upper extremity of the active insert.

The external diameter of the active insert at its upper extremity can be greater than the internal diameter of the top of the protrusion (e.g. on the inner surface of the side wall of the container body) (i.e. apex of the protrusion in the direction of the central vertical axis of the container). This allows the active insert to be mounted in the container by snap-fastening.

When the active insert is placed inside the container body, the upper extremity of the active insert can be arranged below the top of a protrusion (e.g. on the inner surface of the side wall of the container body). This allows the passage of air towards the interstice between the top of the protrusion and the upper extremity of the active insert.

When the holding portion includes a peripheral recess (e.g. on the inner surface of the side wall of the container body), the latter can be configured to receive at least part of the side wall of the active insert. For example, the peripheral recess can be adjacent to the upper extremity of the active insert and receive the upper extremity of the active insert. Thus, once the active insert has been mounted inside the container body, the recess (groove) prevents disassembly of the active insert by interaction with the upper extremity of the active insert.

The holding portion (e.g. on the inner surface of the side wall of the container body) can include a peripheral recess and a peripheral protrusion located above the peripheral recess.

The internal diameter D2 of the container body increases in the direction of the opening of the container body.

The external diameter D1 of the active insert increases at least partially from its lower extremity towards its upper extremity. This allows in particular the active insert to be mounted more easily inside the container body.

The side wall of the active insert includes a flared upper part. In other words, the external diameter D1 of the active insert increases more significantly on the flared part, with the upper extremity of the insert having the largest diameter. As an example, an insert with a flared upper extremity may present an advantage given that—as the distance is further increased between the side wall of the insert and the sidewall of the container body below the flared part air can escape when the insert is mounted in the container body and limit the "piston effect". With the provision of the flared upper part, when engaging the insert into the container body there may be no contact between the sidewalk of the insert and the sidewall of the container, until the flared upper part of the insert is contacting the upper holding portion. Such, the air between the outer surface of the insert and the inner surface of the container body which is compressed during the assembly motion (relative translation of the insert into the vial body), can freely escape via the continuous gap formed all around the insert and the container body. This may reduce the force to be applied for engaging the insert into the container body and may allow for higher speeds of assembly, which may become especially advantageous in automated mass-production installations where multiple units of vial boy and inserts are assembled simultaneously.

The flared upper part represents at least 2% and/or at most 10% of the length L of the active insert, preferably from 5 to 10% of the length L of the active insert.

The outer surface of the flared part forms an angle $\alpha$ of at least 135° with the outer surface of the side wall of the active insert, with which it is contiguous, preferably an angle of less than 180% preferably an angle of between 135° and 175°, more preferably 170° and 175°. In an example, when the active insert is made of materials with high rate of filler (or active agent) it may generally not be very flexible and can therefore break more easily, for example during assembly, if the dimensional constraints are not appropriate.

Over at least 50% of the length L of the side wall of the active insert, preferably at least 80%, the external diameter D1 of the active insert is less than the internal diameter D2 of the container body. For example, the external diameter D1 of the active insert can be less than the internal diameter D2 of the container body substantially throughout the length L of the side wall of the active insert, with the exception of the area adjacent to the holding portion(s). Furthermore, when it is not assembled in the container body, the external diameter of the active insert can be greater than or equal to the internal diameter of the container body at the level of its holding portion. Thus, once the insert is mounted inside the container body, it is held by pressure: the holding portion of the insert is in contact with the holding portion of the side wall of the container body and exerts pressure on the inner surface of the side wall of the container body.

Preferably, the difference between the external diameter D1 of the active insert and the internal diameter D2 of the container body is at least 0.04 mm, preferably at least 0.1 mm, over at least 50% of the length L of the side wall of the active insert, preferably over at least 80% of the length L of the side wall of the active insert.

Favourably, substantially throughout the length L of the side wall of the insert, the external diameter D1 of the active insert is less than the internal diameter D2 of the container body. It is understood that this is valid when the active insert is correctly mounted inside the container body and does not exclude any potential variations in diameter along the side walls of the active insert and/or of the container body.

The outer surface of the base of the active insert may include an inclined surface and the inner surface of the base of the container body may include an inclined surface complementary to the inclined surface of the base of the insert. These complementary inclined surfaces allow the active insert to be guided during mounting inside the container and ensure proper centring of the active insert inside the container body. These inclined surfaces are particularly useful in the context of the present invention, because, in view of the presence of an (e.g. small) interstice between the two parts, a slight inclination of the axis of the insert in relation to the axis of the container body could prevent appropriate locking of the insert inside the container body (for example by preventing the proper passage or snap-fastening of the upper extremity of the insert throughout the periphery of the corresponding holding portion on the container body). Furthermore, it may allow to properly place the insert relative to the container body such that the insert may not move inside the container body and that the interstice may be maintained at a specific value.

The outer surface of the base of the active insert has a conical bulge and the inner surface of the base of the container body has a cavity having an inclined wall configured to receive the conical bulge of the base of the active insert.

The conical bulge on the outer surface of the base of the active insert is housed inside the conical cavity of the inner surface of the base of the container body.

In a preferred embodiment, two peripheral holding portions are provided. This helps avoiding inclination of the axis of the insert and to ensure that a small empty interstice is provided all around the insert on a large proportion of the external surface of the side wall of the insert. The first holding portion maintains the lower end, of the active insert, preferably by contacting its side wall. It may be formed by a plurality of longitudinal ribs distributed on the circumference of the inner surface of the side wall of the container body. The ribs contact the lower part of the side wall of the insert on less than 20% of its length L. The second holding portion maintains the upper extremity of the side wall of the active insert. It may be provided on the inner surface of the side wall of the container body and include a peripheral recess and a peripheral protrusion located above the peripheral recess. The side wall of the active insert preferably includes a flared upper part, which is snap-fitted below the peripheral protrusion and partially received within the peripheral recess. The diameter of the insert measured at the flared upper part is slightly bigger than the corresponding diameter of container body and a narrow peripheral contact surface is formed between the upper extremity of the active insert and the inner surface of the container body. Preferably the vertical extension of the contact surface is of less than 1 mm, preferably less than 0.5 mm, more preferably less than 0.2 mm.

The contact surface $S_{contact}$ between the outer surface of the active insert and the inner surface of the container body is less than 5% of the total surface area of the active insert $S_{insert}$, preferably less than 2%. For example, the contact surface provided by both holding portion at the lower end of the active insert (for example longitudinal ribs on the inner surface of the side wall of the container body that are in contact with a lower part of the side wall of the insert) and an holding portion on the upper extremity of the active insert (for example a contact line between the upper extremity of the active insert and the inner surface of the container body of less than 1 mm) is less than 2% of the total surface area of the active insert $S_{insert}$. This allows a better circulation of the air around the outer side of the insert while the insert is maintained immobile within the container body.

The container body may furthermore include a fastening means configured to receive a cap, preferably a hinged cap (or cap with a hinge).

The fastening means is arranged on the outer surface of the side wall of the container body. This could for example consist of a flange or an element formed on the outer surface of the side wall of the container body and on which a cap-connecting element is fixed. Examples of fastening means and connecting elements that can be used are for example described in U.S. Pat. No. 8,875,917, in which the container body includes a flange configured to receive a ring element of a hinged cap, or in U.S. Pat. No. 8,960,491, in which the container body includes a means of connection that engages with a connecting element of a hinged cap.

If the fastening means is a peripheral flange, this flange is preferably continuous, i.e. formed over an entire periphery of the container body; in another embodiment, the flange may be discontinuous.

The flange is located towards the upper end of the side wall of the container body near the opening of the container body. In other words, it is placed on a portion of the side wall of the container body which is adjacent to the opening of the container body.

The flange has a vertically measured thickness T1 at the junction point with the container body which is less than the horizontally measured thickness T2 of the side wall of the container body. Preferably $T1 \leq \frac{2}{3}T2$, preferably $T1 \leq \frac{1}{2}T2$.

The flange is reinforced by an array of ribs joining the flange to the outer surface of the side wall of the container body. These ribs are particularly useful for reinforcing the flange when its thickness is very reduced.

The flange has a horizontal portion extending from the side wall of the container body to the outside and is perpendicular to it. In other words, the horizontal portion (or section) extends radially outwardly from the side wall of the container body.

The flange further comprises a vertical portion extending from the end of the horizontal portion of the flange vertically. Preferably, the vertical portion (or section) extends perpendicularly to the horizontal portion. It can extend towards the opening of the container body (i.e. upwards when the container body rests on its base) or towards the base of the container body (downwards). Preferably the vertical portion extends downwardly.

The horizontal portion of the collar includes a horizontal top surface, preferably flat. This horizontal surface serves to support the connecting element of the cap (preferably hinged) and makes it possible to immobilise and vertically secure the cap on the flange while preventing the cap from sliding or disengaging from the flange, especially when too great a force is applied to the cap, for example during the assembly phase of the cap on the container body. This configuration has an advantage over existing flanges that have an inclined top surface on which the cap-connecting element tends to slide along the flange or even pass below the flange when the cap is mounted on the container body. Another advantage is that, with the cap being held vertically on the flange, the axis of rotation of the cap's hinge is fixed and well defined, which makes it possible to precisely define the rotation of the cap during the opening and closing cycles and thus the proper positioning of its sealing means and quality of the seal in the closed position, for better air and moisture tightness.

The horizontal top surface of the horizontal portion includes, at its outer end, a rounded or chamfered portion. This makes the cap easier to assemble, in particular an easier assembly of the cap's connecting element on the fastening means of the container body which requires less force. Furthermore, the radius makes it possible to guide and centre the cap around the flange during its assembly when the cap is not perfectly aligned with the container body on the assembly lines.

The collar has an angular cross-section, preferably at an angle of 90°. This angle is formed by the horizontal portion and the vertical portion of the flange.

The angular shape has a rounded upper surface; in other words, the horizontal top surface of the horizontal portion has a rounded shape at its outer end from which the vertical portion extends. Thus, the flange has a radius between the horizontal top surface of the horizontal portion and the outer side surface of the vertical portion. The rounded top surface allows for easier assembly of the cap on the flange of the container body, requiring a little less precision for the alignment of the cap with respect to the flange and less force for the snap-fastening of the cap's ring connecting means of the container on the flange.

The angular shape has a chamfered top surface. In other words, the angular shape has a chamfer between the horizontal top surface of the horizontal portion and the outer side surface of the vertical portion. The chamfered top surface also facilitates assembly of the cap onto the flange of the container body.

The angular shape has a right angle between the horizontal top surface of the horizontal portion and the outer side surface of the vertical portion.

The thickness of the horizontal portion of the flange is smaller than the thickness of the vertical portion.

The thickness of the horizontal portion of the flange is smaller than the thickness of the side wall of the container body.

The ratio between the thickness of the horizontal portion of the flange and the thickness of the side wall of the container body in the area adjacent to the horizontal portion is less than or equal to ⅔, preferably ½. In other words, the thickness of the horizontal portion represents at most ⅔ of the thickness of the container body's wall, taken at its junction with the horizontal portion of the flange. This thickness makes it possible in particular to avoid shrinkage (deformations or hollows) on the internal surface of the container body directly adjacent to the flange, and thus to guarantee a well-defined internal surface on this area, even using cooling cycle times during the manufacturing process, for example by injection moulding, of the container body.

The container may also include a cap, preferably hinged. The cap can be moulded in a single piece with the container body, for example connected to the container body by means of a film hinge. Alternatively, the cap can be moulded independently of the container body and assembled to the container body via the fastening means. This has the advantage in particular of being able to use different materials and/or colours for the cap and for the container body.

The cap includes a lid portion, configured to impermeably dose the opening of the container body.

The cap can furthermore include a connecting element, configured to be fixed on the fastening means of the container body.

The cap can furthermore include a hinge between the lid portion and the container body. The presence of a hinge offers the advantage of having a hinged cap that remains attached to the container during the opening and closing cycles of the container. The hinge can optionally be connected to a cap-connecting element by being fixed on a fastening means of the container body.

The cap is made of plastic. The plastic material may be the same or different from that of the container body. Preferably, the plastic material is different from that of the container body. For example, it may be advantageous to use a (e.g. slightly) more flexible (lighter for example) material for the cap than that of the container body.

The cap is injection moulded.

The plastic material of the cap has a low permeability to moisture and/or oxygen, preferably to moisture. The plastic material may be chosen from polyolefins (polyethylene, polypropylene), polyesters, polycarbonate, cycloolefin, preferably polyolefin, in particular polypropylene and/or polyethylene.

The cap can be a single material or injected in two different materials to combine the barrier properties of the materials with different gases (an oxygen barrier material combined with a moisture barrier material for example) or to combine the barrier properties of a first material with the elastic properties of a second material to form the hinge and/or to form a flexible seal.

The cap can be moulded separately from the container body or moulded directly with the container body when a hinge is present.

When the cap includes a connecting element, the latter is configured to be snap-fastened (i.e. to form a positive engagement) on the fastening means of the container body.

The connection element of the cap, preferably hinged, may be a ring element.

The cap-connecting element comprises on its inner surface a vertical cylindrical surface S5 which cooperates with the vertical portion S4 of the flange once the cap is assembled on the container body. Preferably the diameter of the vertical cylindrical surface S5 of the connecting element is smaller than the outside diameter of the vertical portion S4 of the flange before the cap is assembled to the container body.

The connecting element of the cap is made of a resilient material which allows its diametrical extension after assembly on the container body. In this way, and after assembly of the cap on the container body, the connecting element of the cap exerts pressure on the flange, thus limiting the rotation of the cap around the container body, particularly that of an open hinged cap.

The preferably hinged cap is configured to cooperate with the side wall of the container body so as to form an airtight seal. This allows better protection of sensitive products to be stored.

The cover portion has a sealing surface configured to cooperate with a sealing surface on the container body so as to form an airtight seal between the cap and the container body when the cap is in the closed position.

The cover portion comprises a sealing skirt. The sealing skirt is configured to cooperate with the container body so as to form an airtight seal. In other words, the sealing surface of the cap portion is located on this sealing skirt. Preferably, the sealing skirt comprises a bulge on its lower part. The sealing skirt extends in a direction that is substantially perpendicular to the top wall of the cap from the inner side of the cover. It preferably comprises a bulge located towards the lower end of the sealing skirt (the free end of the skirt opposite to the end by which the skirt is attached to the inner side of the top wall of the cover). The bulge is directed towards the side wall of the container body. The bulge formed on the sealing skirt of the lid portion may thus constitute the sealing surface of the lid which cooperates with the side wall of the container body so as to form an airtight seal when the cap is in position closed.

Preferably the lid sealing skirt which cooperates with the side wall of the container body forms the only sealing surface between the cap and the container body.

The sealing surface of the container body is located on the side wall of the container body, preferably on the inner surface of the side wall of the container body. The sealing surface of the container body may be located on a flat portion of the inner surface of the side wall of the container body or may be located in a peripheral groove and/or peripheral bulge formed on the inner surface of the side wall of the container body. The sealing surface located in a peripheral groove may be as described in EP 2966000.

The sealing surface of the container body configured to cooperate with the sealing surface of the lid portion is in a peripheral groove on the inner surface of the side wall of the container body.

The radius of the ring groove is greater than the radius of the bulge on the sealing skirt.

The sealing surface of the container body is preferably not axially adjacent to the peripheral flange (not vertically aligned).

The cap, preferably hinged, further comprises a tamper-evident means. The container fitted with such a cap exhibits the safety characteristics of containers having a tamper-evident system (or evidence of first opening of the container), the said safety characteristics being particularly important in the industry of containers for the storage of medical and/or pharmaceutical products.

The tamper-evident means can comprise:

at least one breakable connection connecting the lid portion to the connecting element, preferably a plurality of breakable links and/or a tear strip connecting the lid portion to the connecting element.

The tamper-evident means is broken when the cap is first opened.

The cap, preferably hinged, does not comprise a drying chamber and/or an active agent.

The cap, preferably hinged, has an opening means with a grip portion and/or a cavity in the lid portion to make it easier to grip.

The cap, preferably hinged, has a total height of less than 15 mm, preferably less than 12 mm.

The cap, preferably hinged, has a total weight of less than 3 g.

When the cap closes the opening of the container body, the container has a moisture penetration rate W of less than 1 mg/day at 40° C. and 75% relative humidity (RH), established according to the standard method ASTM D7709, preferably less than 0.7 mg/day, preferably less than 0.5 mg/day.

The degree of penetration of moisture is in particular a function of the length of the seal between the cap and the container body. The length of the seal means the perimeter of the opening measured perpendicular (i.e. adjacent) to the sealing surface between the cap and the container body. When the cap closes the opening of the container body, the container has a moisture penetration rate W of less than 10 μg/day/mm of seal length, preferably less than 7 μg/day/mm of the seal length at 40° C. and 75% relative humidity (RH). In other words, for a circular container with a seal of 25 mm diameter, the container has a moisture penetration rate of less than 785 μg/day at 40° C. and 75% RH. The moisture penetration rate of the cap and its seal can be determined by, for example:

Measuring the moisture penetration rate of the container closed normally by its cap according to test method ASTM D7709.

Measuring the moisture penetration rate of the container body, without the cap but with the opening closed by a moisture-proof device, such as an aluminium lid welded on the opening, for example.

The difference in permeability between the two experiments corresponds to the moisture penetration rate of the cap and its seal.

The moisture penetration rate is also a function of the dimensions and construction materials of the container. Considering:

W the moisture penetration rate of the container closed by its cap and established at 40° C., 75% RH according to standard method ASTM D7709, $S_t$ the total external surface area of the container S in m2, e the mean thickness of the container in mm, the permeability by moisture of the container closed by its cap $P=W\cdot e/S_t$ is less than 375 mg·mm/m$^2$·day, preferably 210 mg·mm/m$^2$·day, preferably 160 mg·mm/m2·day at 40° C., 75% RH.

The active insert assembled in the container body reaches 50% of its maximum capacity in less than 12 days, preferably in less than 10 days, when the storage volume is subjected to an environment of 65% RH and 30° C.

The active insert assembled in the container body includes a desiccant and is capable of trapping at least 250 mg of moisture when stored for 5 days at 30° C. and 65% RH. Therefore, the active insert can for example have an external volume of 15 to 30 $cm^3$ (with a diameter of 20 to 70 mm and a volume of material $V_m$ of at least 4 $cm^3$).

The active insert assembled in the container body includes a desiccant and is capable of trapping at least 50% of its maximum absorption capacity in weight of water in less than 12 days at 30° C. and 65% RH, preferably in less than 10 days.

The invention also includes a manufacturing method of the container. The method includes:

the moulding of a container body as described in the claims, in particular by thermoplastic injection.

the separate moulding of an active insert, before, after or at the same time as the moulding of the container body, in particular by thermoplastic injection, and assembly of the active insert inside the container body.

The active insert can be assembled in the container body by any known state-of-the-art assembly technique. It can be held inside the container body by, for example, clamping, friction, snap-fastening, welding or bonding.

Such assembly and the advantageous characteristics of the container body and of the insert result in increased moisture absorption kinetics by the active insert compared, for example, with over moulding the container body around the active insert.

The assembly of the active insert inside the container body is preferably carried out shortly after the moulding of the container body, preferably within 24 hours after moulding of the container body, even more preferably within an hour after moulding of the container body. For example, when the container body has just been moulded (for example by injection moulding), although the container body has been cooled overall, the material remains sufficiently malleable to allow the active insert to be placed inside the container body without tearing the undercut parts present on the inner surface of the container body. Furthermore, the moulding and cooling of the plastic container body are generally accompanied by a shrinkage of the material (and a reduction in diameter) which can vary in scale depending on the polymer material and the thickness of the container body.

The process allows an easy assembly of the active insert, by making best use of subsequent cooling and shrinkage of the material, i.e. by making best use of the variation in diameter of the container body in order to assemble the active insert, preferably when this diameter is at its largest.

The invention also relates to the use of such a container for the storage and/or packaging of medical and/or pharmaceutical products. The sensitive products may for example be medication, such as effervescent or non-effervescent tablets, capsules, granules, powders, food supplements such as vitamins or minerals, but also diagnostic strips.

The invention also includes a method for filling this container with medical and/or pharmaceutical products. The method includes:

the supply of a container according to the invention comprising an active insert inside a container body and equipped with a fastening means, preferably a flange, configured to receive a connecting element of a preferably hinged cap, filling the container body with medical and/or pharmaceutical products, and the assembly of a cap, preferably hinged, on the fastening means of the container body, preferably by applying a vertical pressure to the cap. The assembly of the cap can be achieved by snap-fastening the cap-connecting element to the fastening means of the container body.

The container body can be conveyed on conventional filling lines designed for snap-fastening of a cap on the container body: after the container body equipped with its active insert has been filled with the sensitive products, the container body is conveyed to an assembly station. Then, a line supplied with caps deposits the cap on the opening of the container body and a vertical pressure is applied to snap and secure the cap onto the flange of the container body.

DETAILED DESCRIPTION OF THE INVENTION

Figure 1:
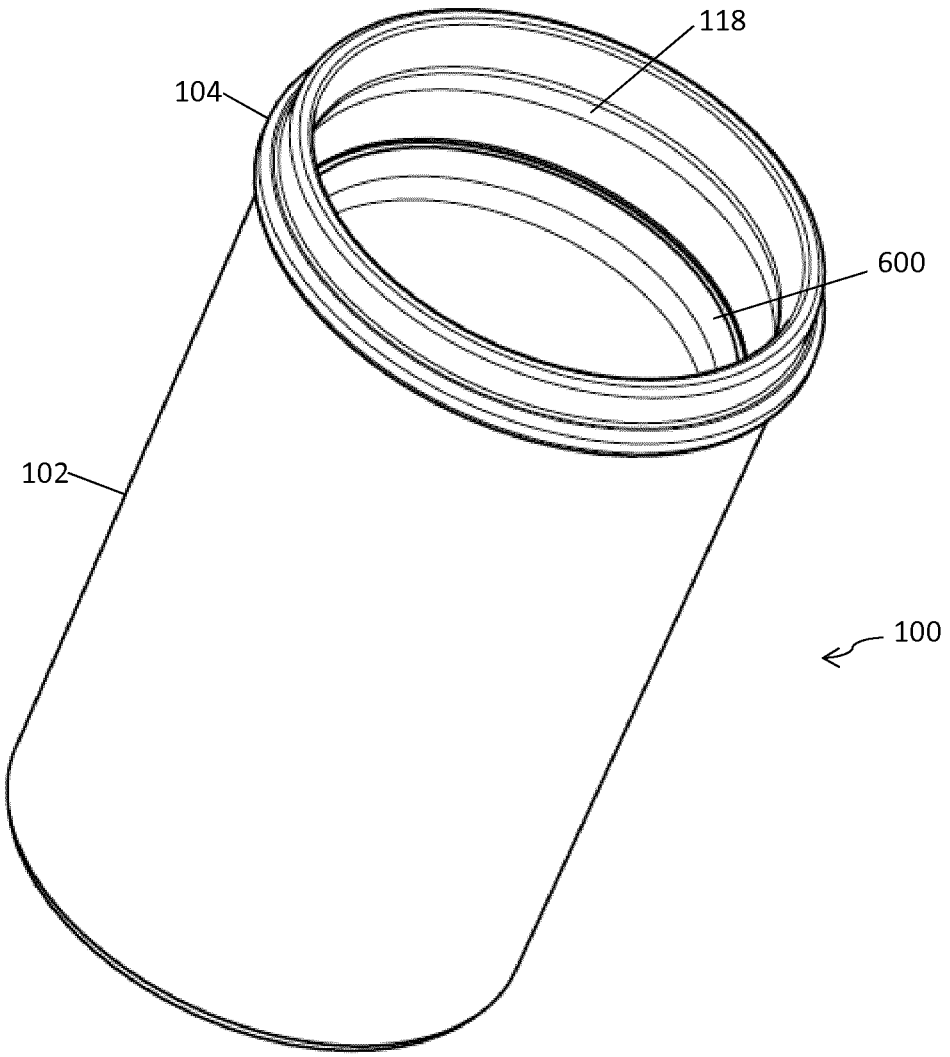
FIGS. 1-2 respectively show a perspective view and a cross-sectional view of an example of a container according to the invention.

The references below are used in the figures:

100 container

12 empty interstice (between the outer surface 609 of the side wall of the active insert 600 and the inner surface 115 of the container body 102)

14 empty interstice in the base (or bottom)

102, 102' container body

103 horizontal part (or portion) of the flange 104

104 fastening element/flange

105 vertical part (or portion) of the flange 104

108 storage volume

110 peripheral recess (holding portion of the container body 102)

112 peripheral protrusion (holding portion of the container body 102)

113 top of peripheral protrusion 112

115 inner surface of container body

116 conical cavity on the inner surface of the bottom of the container body 102

118 peripheral cavity or groove on the inner surface of the container body 102

123 inclined surface on the inner surface of the bottom of the container body 102

150 junction area between the flange 104 and the side wall 202 of the container body
190" axial ribs on the inner surface of the side wall of the container body 102"
202 side wall of the container body 102
204 base (or bottom) of the container body 102
206 opening of the container body 102
300, 300' container hermetically closed by a cap
310 hinged cap
312 ring connecting element
314 lid portion
315 sealing skirt
318 bulge of the sealing skirt 315
321 protrusion on the inner surface of the connecting element
323 protrusion on the inner surface of the connecting element
325 recess on the inner surface of the connecting element
412 hinge (connecting the lid portion 314 to the ring element 312)
414 tamper-evident means
512 gripping portion (opening means)
514 cavity portion (opening means)
600, 600', 600" active insert
602, 602', 602" side wall of the active insert
604, 604', 604" base (or bottom) of the active insert
605, 605', 605" upper extremity of the active insert
606 lower extremity of the active insert 600
607, 607', 607" flared upper part of the active insert
609 outer surface of the active insert 600
613 portion of the outer surface 609 forming the outer surface of the flared upper part 607 of the active 600 insert
614, 614" conical bulge on the outer surface of the base of the active insert
622, 622" inclined surface on the outer surface of the base of the active insert
690" elevated surfaces on the outer surface of the base of the active insert 600"
692" recessed surfaces on the outer surface of the base of the active insert 600"
694" bevelled surfaces on the outer surface of the base of the active insert 600"
760 empty interstices formed by cuts or notches on the container body
860 cuts or notches
870 longitudinal ribs
S1 outer surface of the side wall 202 of the container body 102
S2 inner surface of the side wall 202 of the container body 102
S3 horizontal upper surface of the horizontal part 103
S4 outer side surface of the vertical part
S5 inner surface of the cap-connecting element
T1 thickness of the horizontal part 103 of the flange 104
T2 thickness T2 of the side wall 202 of the container body 102

Figure 2:
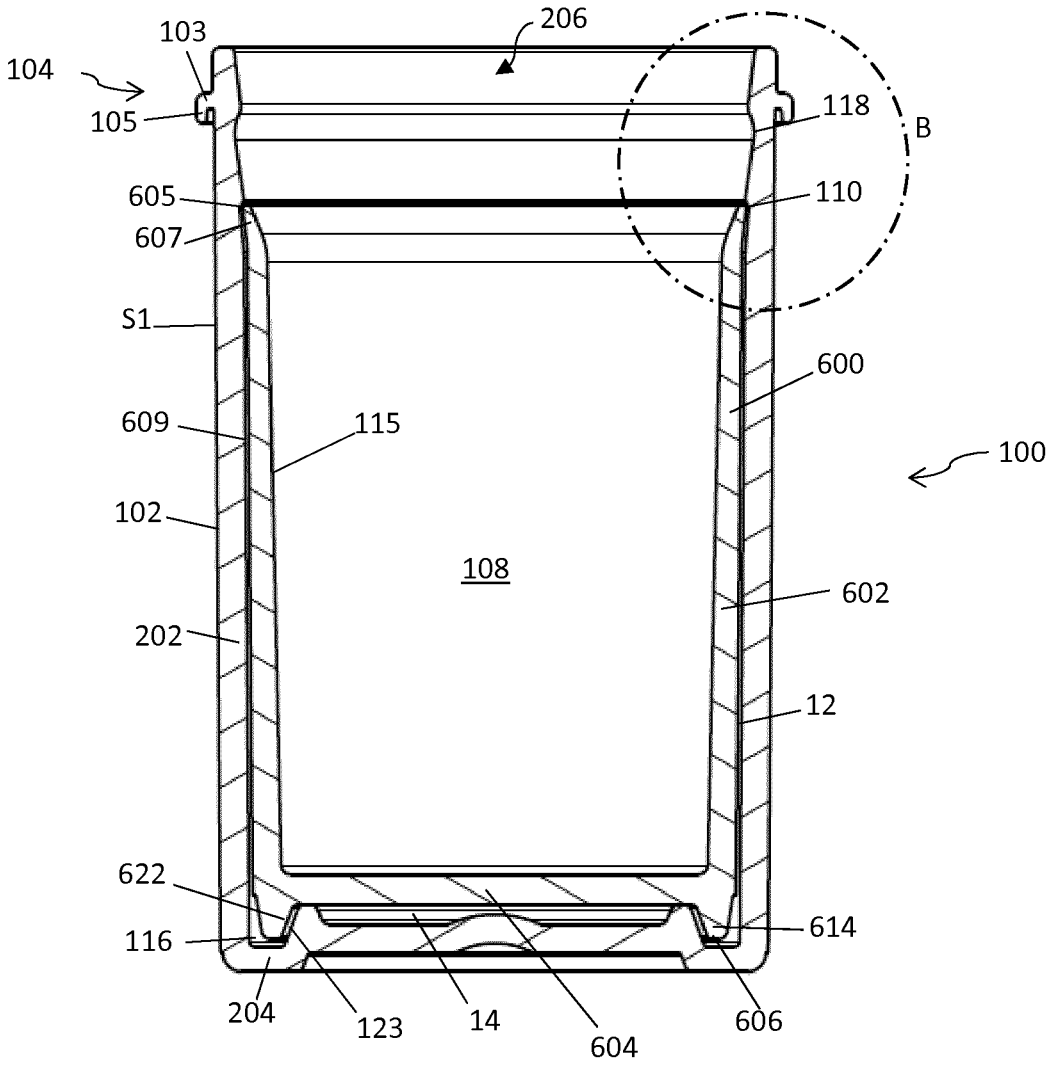
Figure 3:
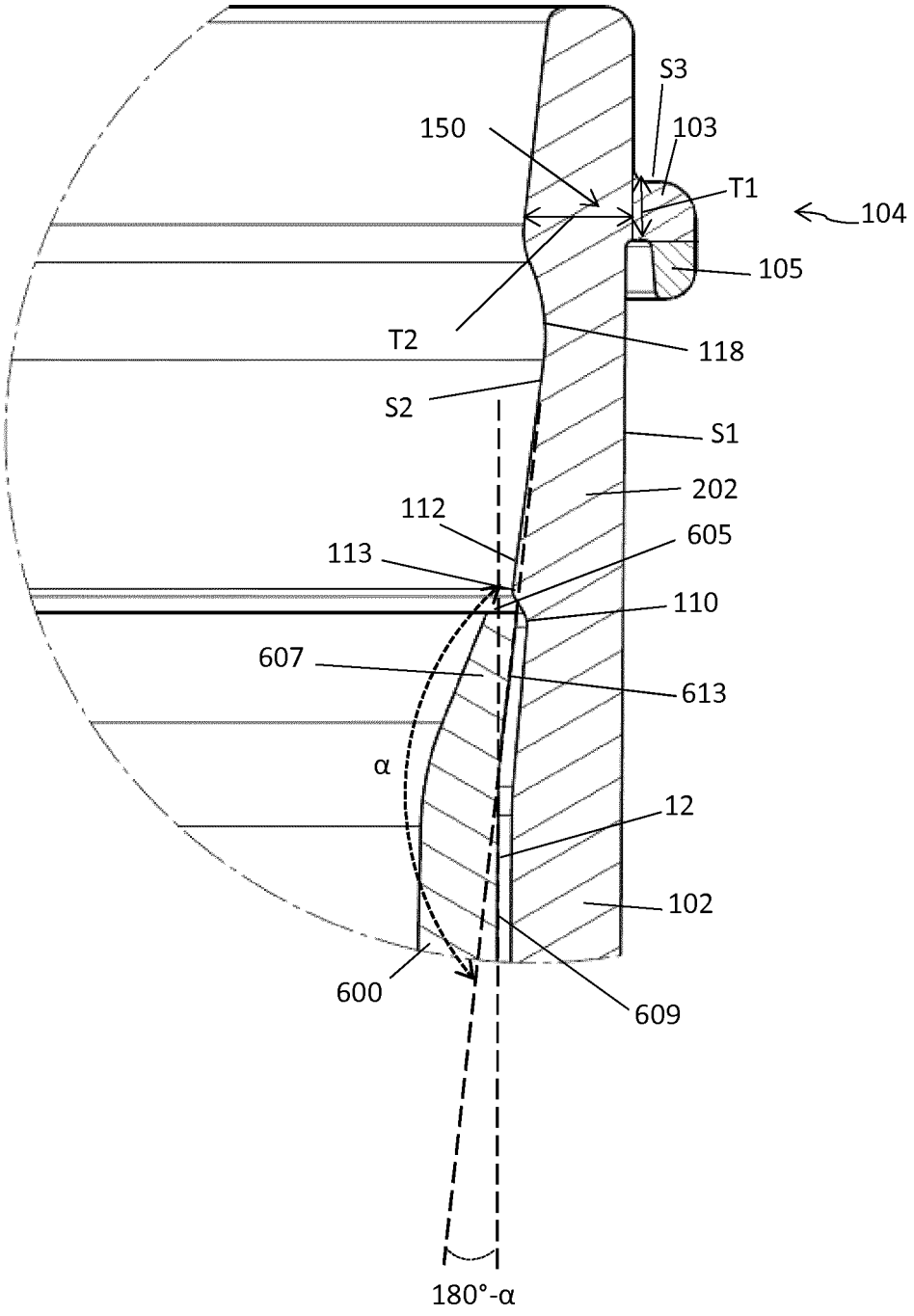
FIG. 3 shows an enlarged cross-sectional view of area B of FIG. 2.

FIGS. 1-3 show a container 100 according to the invention, without a cap. The container 100 includes a plastic container body 102 and an active insert 600 arranged inside the container body 102

The container body 102 comprises a tubular side wall 202, a base 204 and an opening 206. The container body 102 defines a storage volume 108. In FIG. 2, the container is resting on its base 204. The side wall 202 of the container body 102 has a generally cylindrical shape, here in circular section.

The active insert 600 includes a tubular side wall 602 with a length L, extending from a lower extremity 606 to an upper extremity 605. Here, the active insert also includes a base 604, axially spaced from its upper extremity 605.

An empty interstice 12 between the side wall of the active insert and the side wall of the container body extends over at least 50%, preferably at least 80%, of the outer surface of the side wall of the active insert 600.

The empty interstice 12 is in particular formed of an empty tubular space between the side walls of the active insert 600 and of the container body 102.

The empty interstice 12 extends over at least 50%, preferably at least 80%, of the length L of the side wall 602 of the active insert 600. More specifically, the empty interstice 12 extends substantially throughout the length L of the side wall 602 of the active insert 600. Thus, an empty tubular space 12 extends substantially over the entire height of the active insert 600, from the outer surface 609, 613 of the active insert 600 to the inner surface of the container body 102.

The width of this empty interstice 12 ranges from 0.05 mm (just below the upper extremity 605) to 0.3 mm (at the level of the side wall of the active insert which is adjacent to the base 604). In other words, the difference between the external diameter D1 of the active insert 600 and the internal diameter D2 of the container body 102 is at least 0.1 mm over at least 50%, preferably at least 80%, of the length L of the side wall of the active insert.

An empty interstice 14 also extends substantially over the outer surface of the base 604 of the active insert 600.

The external diameter D1 of the active insert 600 increases from its lower extremity 606 towards its upper extremity 605. Furthermore, the internal diameter D2 of the container body increases here slightly in the direction of the opening of the container body (from its lower extremity towards its upper extremity).

The inner surface S2 of the side wall 202 of the container body 102 is configured to hold the active insert 600 within the container body 102. In particular, the inner surface of the side wall 202 of the container body 102 has a holding portion, provided by a protrusion 112 and a peripheral recess 110. The protrusion 112 is located above the upper extremity 605 of the active insert. Moreover, the peripheral recess 110 is configured to receive the upper extremity 605 of the active insert 600. In this way, the holding portion forms a stop that, by interacting with the upper extremity 605 of the active insert 600, prevents the active insert 600 from leaving its assembled position in the container body 102.

Here, the holding the active insert inside in the container body does not require clamping between the side walls of the active insert and of the container body. However, a holding by clamping on a localised and restricted portion of the active insert can also be envisaged.

As the outer surface 609, 613 of the active insert 600 is not pressed against the inner surface of the container body 102, this allows a better passage of the atmosphere of the storage volume 108 towards the empty interstice 12 along the outer surface 609, 613 of the active insert 600. The outer surface 609, 613 of the active insert 600 can therefore interact better with gaseous substances (in addition to the inner surface 115 directly accessible from the storage volume). Consequently, the exchange surface area (e.g. $S_{exp}$) or active surface area between the active insert 600 and the atmosphere of the storage volume 108 is increased.

Alternatively, the upper outer surface 613 may be pressed against the inner surface of the container body 102. The outer surface 609, 613 of the active insert 600 can interact with gaseous substances that permeate through the walls of the container body 102 (side wall and bottom wall) and that circulate around the periphery of the active insert 600 by the way of the tubular empty interstice 12.

The side wall 602 of the active insert 600 includes a flared upper part 607. In other words, the external diameter of the active insert 600 near its upper extremity 605 clearly increases in relation to the remaining part of the active insert 600. In these figures, the height of the flared upper part 607 represents at most 10% of the total height of the active insert 600, and more specifically between 5 and 10% of the total height of the active insert 600. This flared part allows better holding of the active insert in the container body while accommodating an empty interstice 12. Furthermore, it may allow to further increase the distance between the side wall of the insert and the sidewall of the container body below the flared part. It may also facilitate the air to escape from the container body during the assembly of the insert in the container body and thus to limit the piston effect. For example, the vertical dotted line illustrated in FIG. 3 shows that, during the assembly, there may be no contact between the side wall of the insert and the side wall of the container until the flared upper part of the insert reaches the top 113 of the protrusion 112. Such an annular gap may be maintained between the insert and the container body during the assembly process which may allow the air to escape.

The outer surface 613 of the flared upper part 607 of the active insert 600 forms, with the outer surface 609 of the active insert 600, an angle $\alpha$ of less than 180% preferably between 170 and 175°. This order of magnitude for the angle $\alpha$ is optimal because the active materials of which the active insert 600 is made of are generally not very flexible and can therefore break more easily, for example during assembly, if the dimensional constraints are not appropriate.

The external diameter of the upper extremity 605 of the active insert 600 is less than the internal diameter of the container body 102 measured from the top of the peripheral recess 110 (as shown in FIG. 3). More particularly, the external diameter of the upper extremity 605 of the active insert 600 is more than the internal diameter of the container body 102 measured at the top 113 of the protrusion 112. In this manner, the insert is secured within the container body by snap-fit. There can be an edge-surface contact between the upper extremity of the insert and the inner surface of the side wall of the container body. In other words, in a cross-section perpendicular to the axial direction, the external diameter of the upper extremity 605 of the active insert 600 is larger than the facing internal diameter of the container body.

FIG. 2 (and also FIG. 6) shows that the outer surface of the base of the active insert 600 furthermore includes an inclined surface 622. The inner surface of the base of the container body 102 includes an inclined surface 123 complementary to the inclined surface 622 of the base of the active insert 600. These complementary inclined surfaces allow the active insert to be guided during assembly inside the container and ensure proper centring of the active insert inside the container body (e.g. including the proper centring for maintaining the empty tubular interstice all around the periphery of the insert). More specifically, the outer surface of the base of the active insert 600 has a ring-shaped conical bulge 614 (having an inclined wall 622). Furthermore, the inner surface of the base of the container body 102 has a cavity 116 (having an inclined wall 123). The cavity 116 is configured to receive the conical bulge 614 of the base of the active insert.

The container can be obtained by independently moulding the container body 102 and the active insert 600, preferably by injection (e.g. injection molding), then by assembling the active insert 600 inside the container body 102. The active insert 600 may be assembled within the container body 102 for example by pushing the active insert 600 into the container body 102, preferably within 24 hours after moulding the container body 102. This prevents damage, during assembly, to undercut elements present on the inner surface of the container body 102 (in particular the protrusion 112 and/or the recess 110 present in the inner surface of the container body). In addition, the plastic material in which the container body 102 is made tends to shrink and tighten around the active insert 600 when it cools, enabling the active insert 600 to be held in the container body 102, while leaving an empty interstice 12 that allows an increase in the exchange surface area between the active insert 600 and the surrounding air The container 100 can then be filled with medical and/or pharmaceutical products. The filling can then be followed by the closure of the opening of the container body 102 by a cap so as to obtain a hermetically sealed container (impermeable to air, water vapour or oxygen).

The cap can be moulded with the container body 102 and connected to it by means of a hinge. Alternatively, the cap can be moulded separately and assembled on the container body 102, for example by means of a cap-connecting element configured to be fixed on a fastening means provided on the container body.

Figure 4:
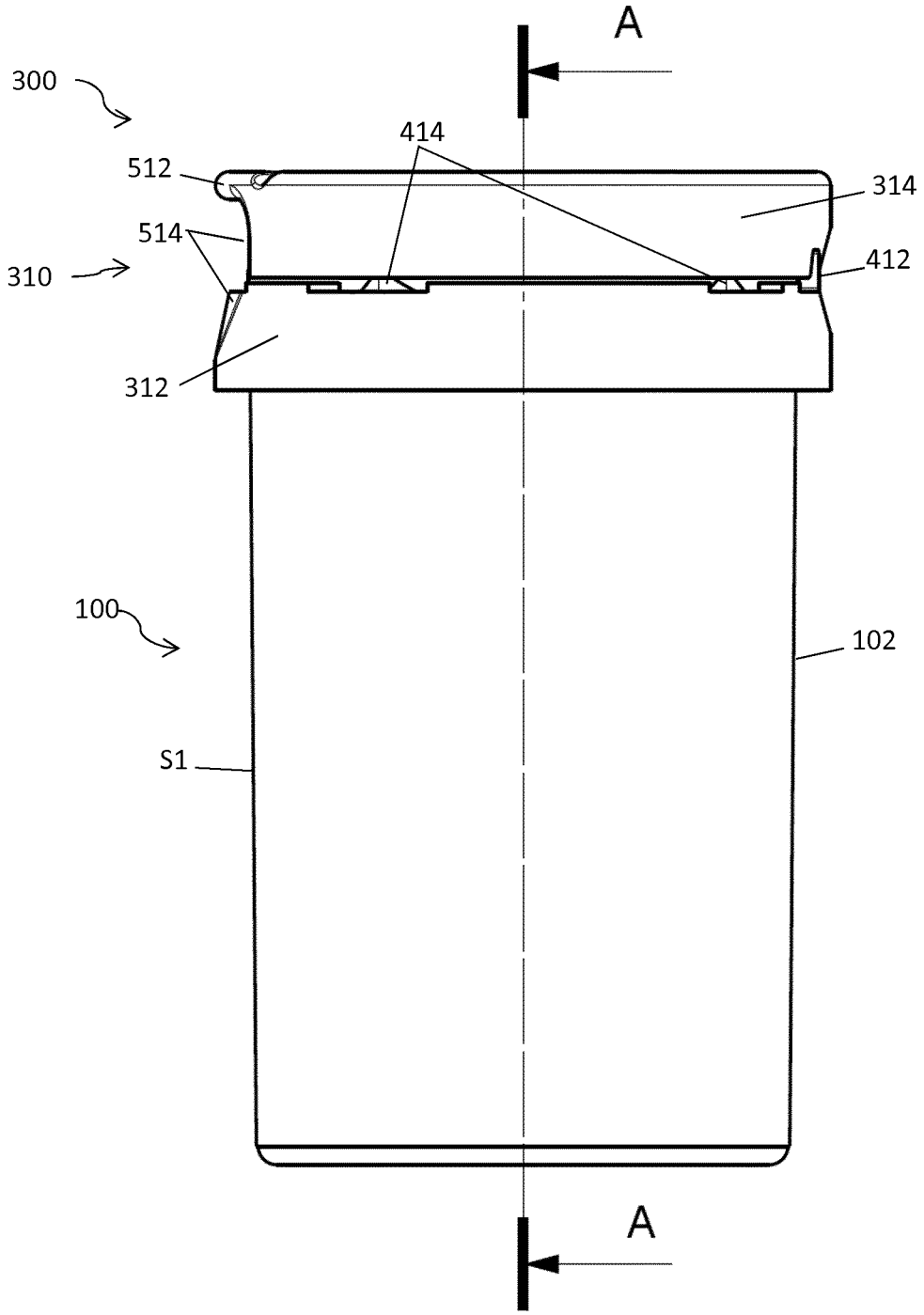
FIGS. 4-5 show profile and front views of the container equipped with a hinged cap.
Figure 5:
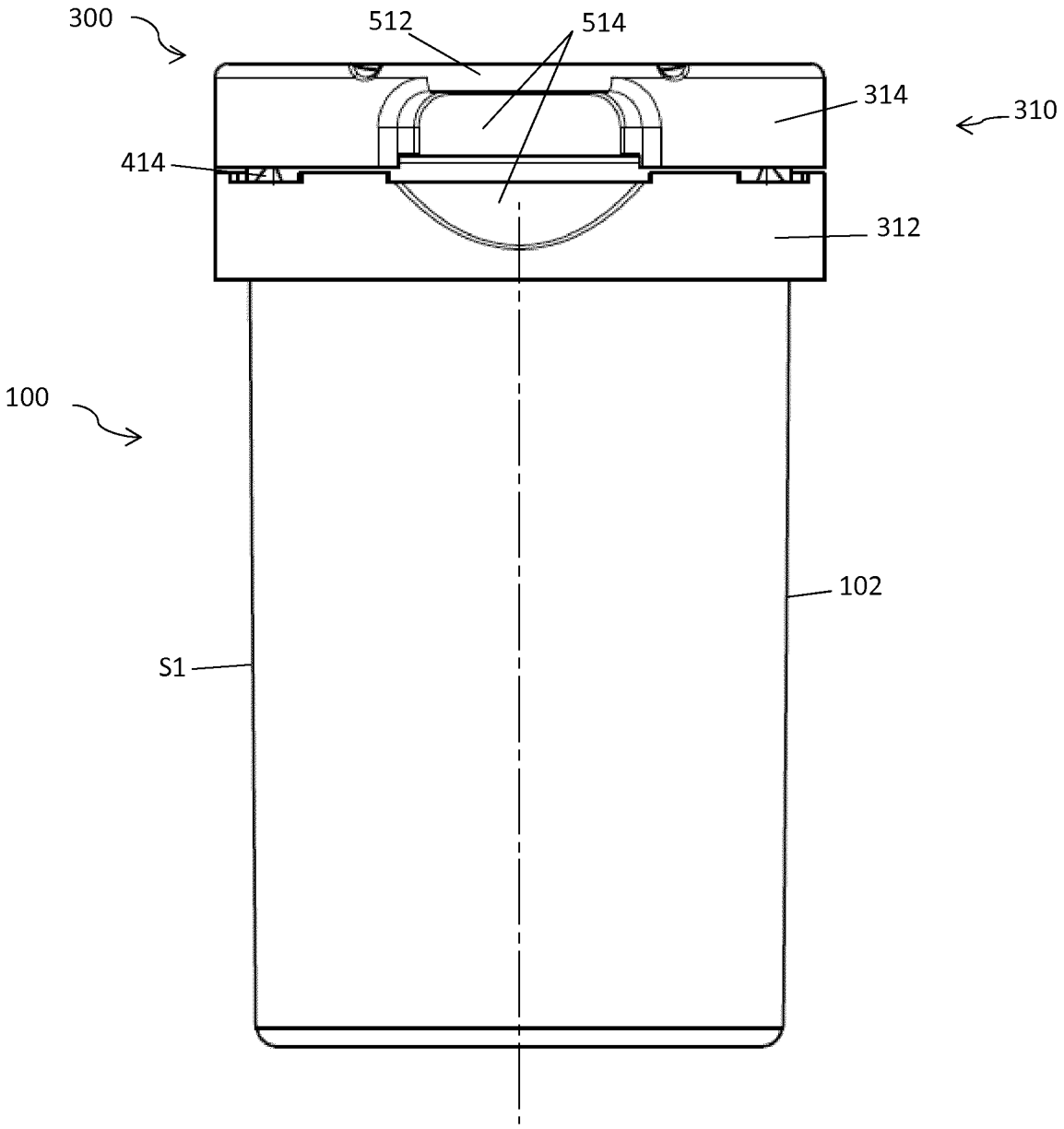
Figure 6:
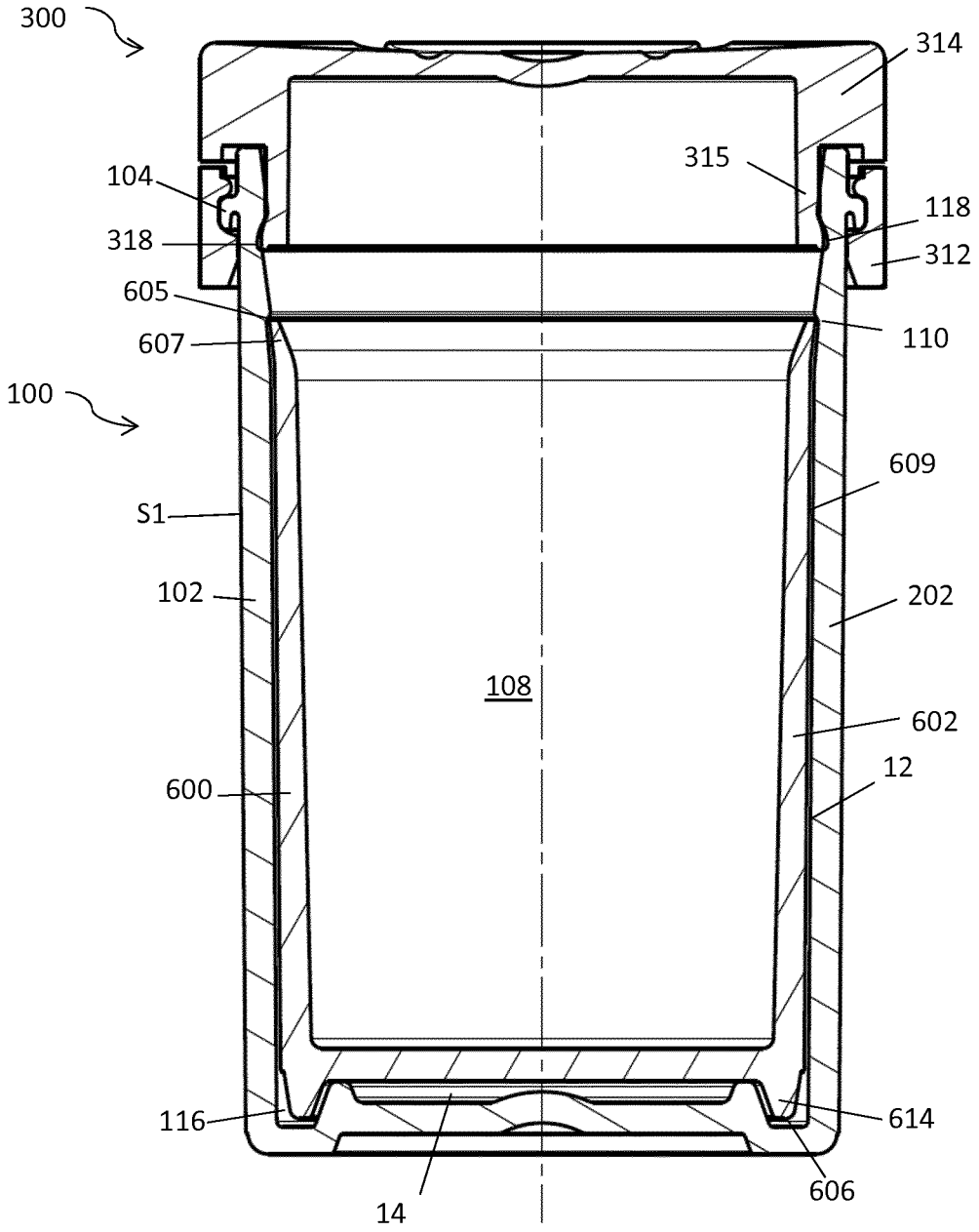
FIG. 6 shows a cross-sectional view along plane A-A of FIG. 4.

FIGS. 4-6 show a closed container 300 consisting of the container 100 in FIGS. 1-3 and a hinged cap 310 assembled on the container body 102.

With reference to FIGS. 1-7, the container body 102 furthermore includes a fastening means 104 configured to fix a cap. The fastening means can be any element enabling a cap or part of a cap to be fixed to the container body.

In the figures, the fastening means 104 is a flange formed on the outer surface of the side wall 202 of the container body.

The flange 104 is peripheral and continuous. In other words, the flange 104 is formed over the entire periphery of the container body 102. The flange 104 includes a horizontal portion 103 which extends perpendicularly from the outer surface S1 of the side wall 202 of the container body 102. The portion 103 forms a ring on the container body 102. The portion 103 comprises a horizontal upper surface S3. This surface S3 prevents the risk of downward displacement of the ring connecting element 312 of the hinged cap 310.

Indeed, on the flanges of known containers comprising an inclined upper surface, the ring connecting element could slide or even disengage from the flange when a strong vertical pressure was applied to the hinged cap 310. The hinged cap thus has the advantage of being firmly attached to the flange.

Moreover, the cap being well maintained on the flange, the axis of rotation of the hinge 412 remains fixed and well defined. The hinged cap can therefore pivot along a fixed and well-defined axis of rotation, which is essential for the sealing surfaces to be correctly positioned when the hinged cap 310 is closed and thus for guarantee a good airtightness between the cap and the container body.

The flange 104 further comprises a vertical portion 105 which extends vertically and downwardly from the periphery of the horizontal portion 103. The portion 105 forms a cylinder around the container body 102. Thus, the flange has a cross-section in the form of an angle, the angle here being 90°. This angular shape allows a particularly good holding of the hinged cap 310 on the flange.

In the figures, the angular shape of the cross-section of the flange 104 is rounded. In other words, a radius is present between the upper surface of the horizontal portion 103 and the outer surface of the vertical portion 105, and optionally the outer edges of the angular shape may meet gently. This also makes it easier to snap, the hinged cap 310 being guided (e.g. by this rounded surface) and refocused around the flange 104 when it is assembled on the container body 102 and to reduce the downward pressures required for the assembly of the hinged cap 310 on the container body 102.

Other embodiments are also possible. For example, the angular shape of the cross-section of the flange 104 may be chamfered or may form a right angle. In the second case, this makes it possible to (e.g. slightly) increase the horizontal upper surface of the horizontal portion 103 and thus to further improve the holding of the hinged cap on the flange.

The horizontal portion 103 has a thickness less than that of the side wall 202 of the container body 102 on the area adjacent to the flange. This means that the thickness T1 of the horizontal portion 103 is smaller than the thickness T2 of the side wall 202 of the container body 102 at the spot where the flange 104 is formed on the container body 102. More particularly, as illustrated in the figures, the T1/T2 ratio is less than or equal to ⅔, and preferably at least equal to ⅓. This range of relative values makes it possible to reduce the risk of shrinkage (or surface defects due to a plastic material accumulation on area 150 at the junction of the flange and due to the shrinkage of this material during cooling) while having a sufficiently resistant flange 104. Such a relative thickness of the horizontal portion 103 thus allows a better quality of the internal surface of the container body 102 which can have a decisive impact on the quality of the airtightness of the container.

The cap 310 includes a lid portion 314, intended to close the opening of the container body in an airtight manner, and a ring connecting element 312, intended to be fixed by means of the fastening means 104 of the container body. The cap also has an optional hinge 412, connecting the lid portion 314 to the ring connecting element 312.

The cap 314 comprises a sealing skirt 315 which has a bulge 318. Furthermore, the inner surface of the container body 102 comprises a peripheral cavity 118. When the cap closes the opening of the container body, the bulge 318 formed on the sealing skirt 315 cooperates with the peripheral cavity 118 of the side wall 202 of the container body 102 so as to form an airtight seal. In this way, the storage volume 108 is sealed from the atmosphere outside the container.

The hinged cap 310 also includes a tamper-evident means comprising here breakable links (or bridges) 414 connecting the lid portion 314 to the ring connecting element 312. The breakable links 414 are broken at the first opening of the hinged cap 310, which is then visible to the consumer.

The hinged cap 310 is also provided with an opening means comprising a gripping portion 512 formed on the lid portion 314 and a cavity portion 514 formed on the lid portion 314 and/or in the ring element 312. Such an opening means is ergonomic.

Such a cap may for example be injection moulded in a single piece in the closed position, using slide moulds.

Figure 7:
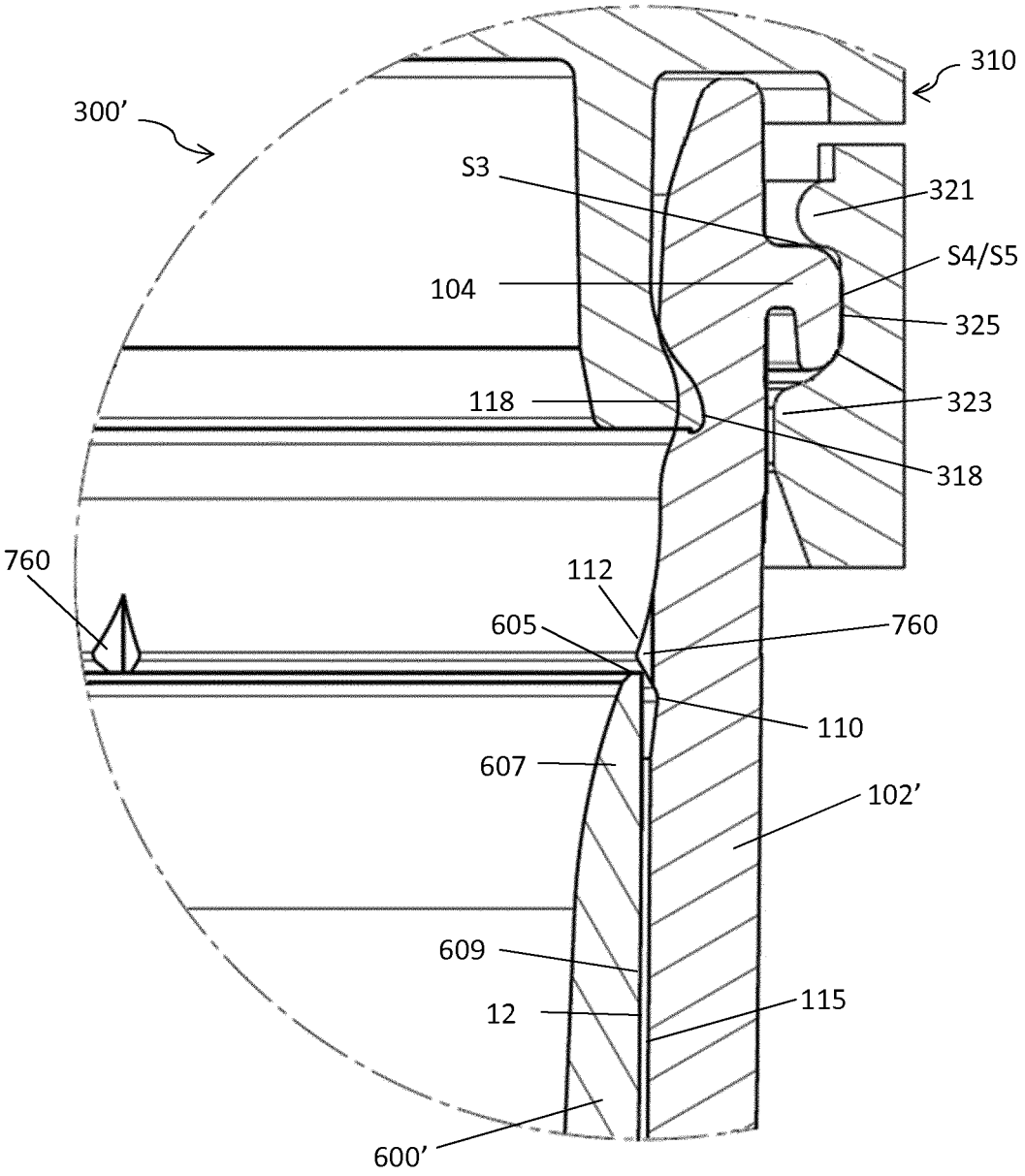
FIG. 7 shows an enlarged cross-sectional view of the container according to another embodiment, comprising a cap.
Figure 8A:
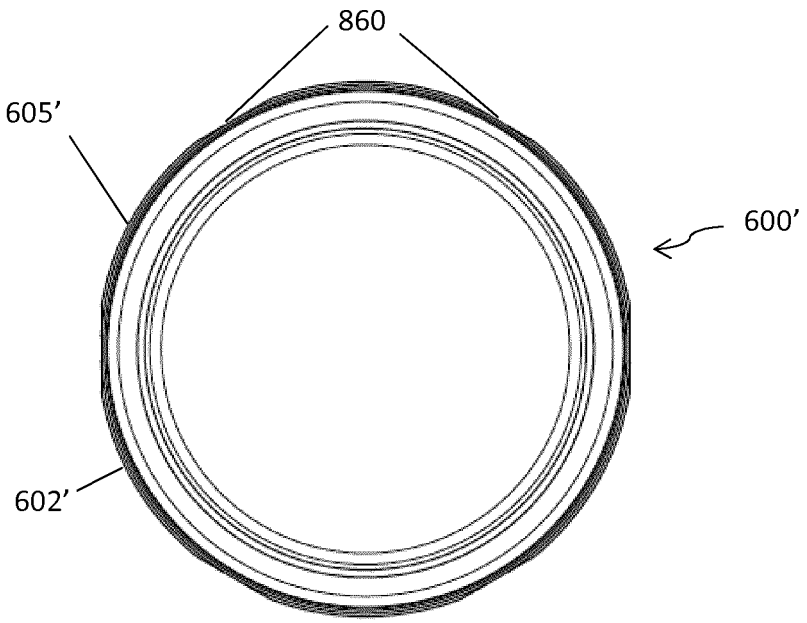
FIGS. 8A and 8B show respectively a view from above and a perspective view of an example of an insert that can be contained in the container according to the invention.
Figure 8B:
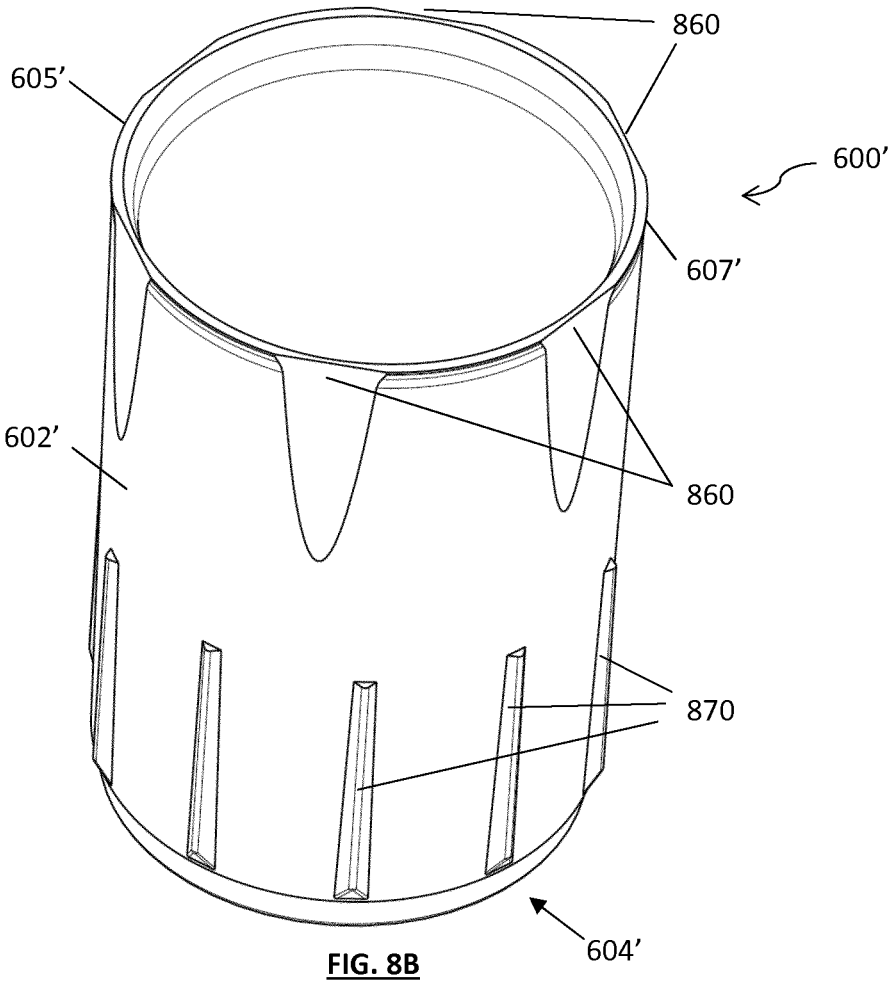

In another embodiment illustrated in FIG. 7, the container 300' includes a container body 102' and an active insert 600'. The active insert 600' is shown in FIGS. 8A-8B. The active insert 600' can be similar to the active insert 600 of FIGS. 1-6, but also includes cuts or notches 860.

The container body 102' is similar to the container body 102 but with some differences. Alternatively, it could be identical to the container body 102.

The active insert 600' includes a flared upper part 607. The upper part may in variations not be flared.

The holding portion of the container body 102' includes a peripheral protrusion 112 and a peripheral recess 110 below the peripheral protrusion 112. The peripheral recess 110 is configured to receive the upper extremity of the flared part 607 of the active insert. Thus, the holding portion of the container body 102' is configured to hold the active insert 600', more specifically to interact with the part 607 of the side wall of the active insert. Here, the holding portion of the container body 102' is configured to interact with the upper extremity 605 of the active insert. In other words, the upper extremity 605 of the active insert 600' cooperates with a holding portion of the inner surface 115 of the container body 102'. More specifically, the outer surface of the (e.g. side wall of the) active insert 600' is in contact with the inner surface of the container body 102' only at its upper extremity 605 (contact of the edge-surface type).

The inner surface 115 of the side wall of the container body 102 furthermore includes additional empty interstices 760 which include cuts or notches created on the peripheral protrusion 112. The cuts allow the passage of air behind the active insert 600' (i.e. in the interstice 12 formed between the outer surface 609 of the active insert 600' and the inner surface 115 of the container body 102'). In other words, the notches 760 bring a certain discontinuity to the peripheral protrusion 112.

In this example, the upper extremity 605 of the active insert 600' is in contact with the peripheral protrusion 112, except at the locations corresponding to the notches 760. Thus, the interstice 12 extend everywhere except on the surface where the peripheral protrusion 112 of the container body is in contact with the upper extremity 605 of the active insert (i.e. on an area of the peripheral protrusion 112 where there is no notch 760). In this way, the active insert 600' can be inserted and held by clamping in the container body 102', while the active surface (exchange surface) is increased by the presence of the empty interstice 12 and the interstices or grooves 760 which enable the air to circulate, substantially throughout the length of the insert.

The connecting element of the cap comprises, on its inner surface, protrusions 321 and 323 intended to receive and fix the flange 104 of the container body 102'. The connecting element of the cap comprises, on its inner surface, a recess 325 (formed between the protrusions 321 and 323) intended to cooperate with the flange of the container body. The cap 310 further includes a sealing skirt comprising a bulge 318 which cooperates with a peripheral cavity 118 on the inner surface of the side wall 202 of the container body 102'.

The connecting element of the cap comprises, on its inner surface, a vertical cylindrical surface S5 which cooperates with the vertical portion of the flange S4 once the cap is assembled on the container body. Preferably the diameter of the vertical cylindrical surface S5 of the connecting element is smaller than the outer diameter of the vertical portion 105 of the flange before the cap is assembled to the container body. The connecting element of the cap is made of a resilient material which allows the diameter of the vertical cylindrical wall of the connecting element to be (e.g. lightly) enlarged during assembly on the container body. In this way, and after assembly of the cap on the container body, the connecting element of the cap exerts a pressure on the vertical surface of the flange, which limits the rotation of the cap around the container body, particularly in the case of an open hinged cap.

FIGS. 8A-8B show the active insert 600', intended to be mounted in a container body 102 or 102'. The active insert 600' includes at least one cut or notch 860 on its outer surface at its upper extremity 605. The cuts 860 allow a better circulation of air behind the active insert 600' (e.g. around the outer surface of the active insert 600') when the active insert is assembled in a container body by creating passages of air and, consequently, allow a greater atmosphere treatment kinetic inside the container.

The active insert also includes longitudinal ribs 870, distributed on the periphery of the side wall of the active insert and on a lower part of the active insert. Alternatively, longitudinal ribs can be located on the inner surface of the side wall of the container body. The longitudinal ribs 870 create a clamping with the inner surface 115 of the container body 102, this clamping being on very localised contact areas. These ribs thus reinforce the holding of the active insert inside the container body and prevent the insert from moving sideways inside the container body. The height of the longitudinal ribs 870 is preferably less than 20% of the length L of the active insert. In this manner, when the insert is assembled into the container body, a tubular empty interstice can extend around the periphery of the insert on at least 80% of the length L of the insert. The longitudinal ribs are located on the lower extremity of the active insert.

Alternatively, the insert can comprise no vertical ribs.

Figure 9A:
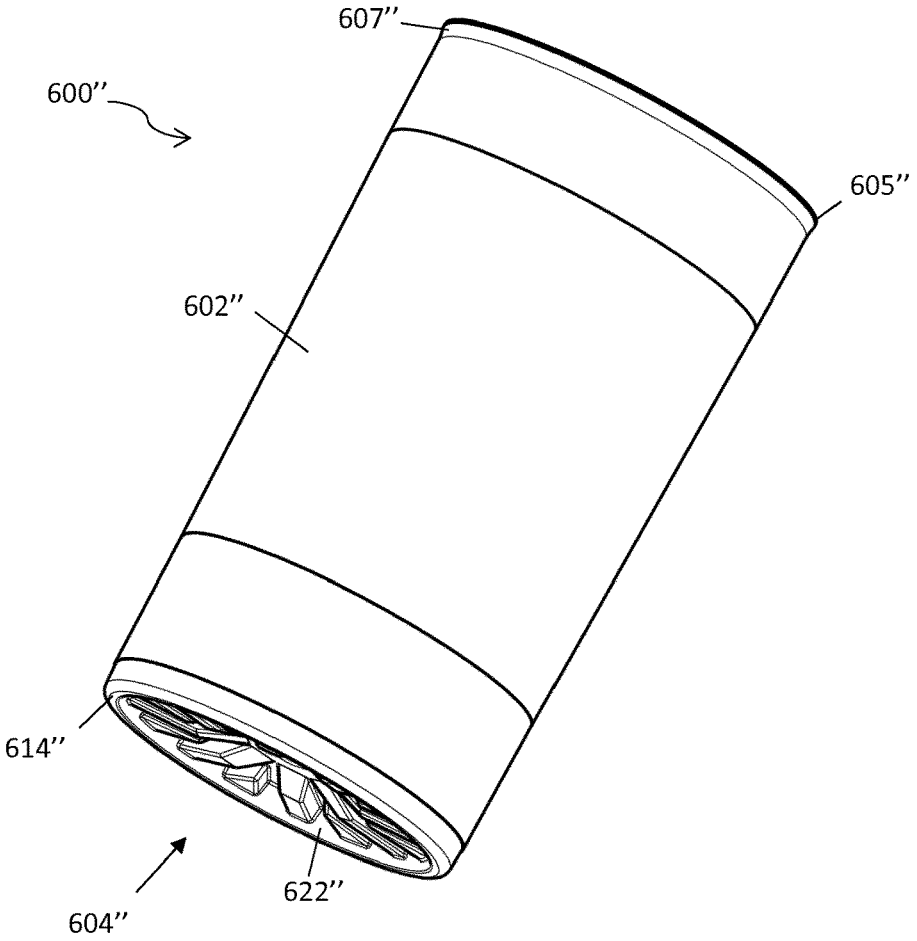
FIGS. 9A and 9B show perspective views of another example of an insert that can be contained in the container according to the invention.
Figure 9B:
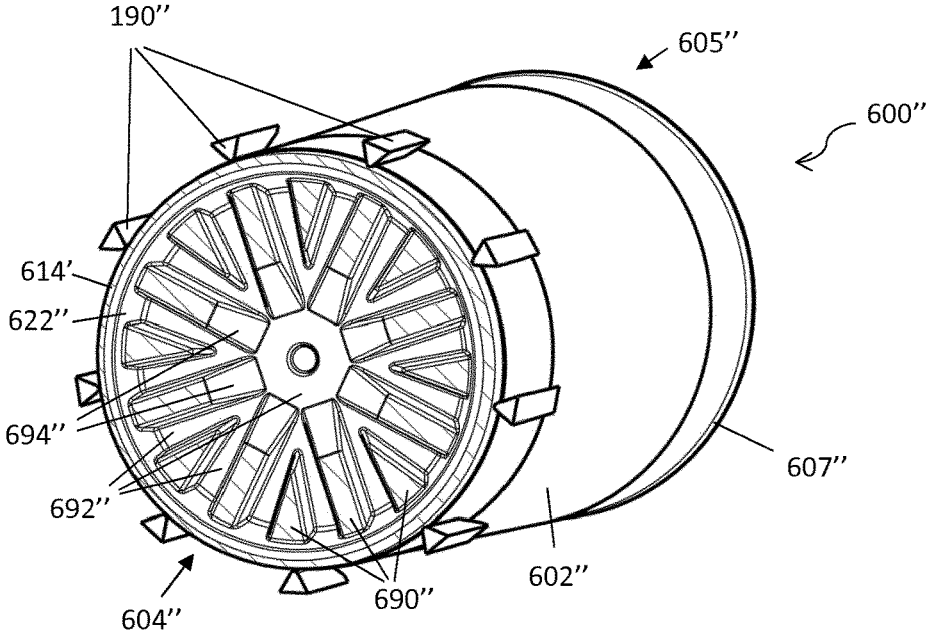

In another embodiment, the container according to the invention can include a container body and an active insert 600" as illustrated in FIGS. 9A and 9B.

The active insert 600" is shown in FIG. 9A. It can be similar to the active insert 600 of FIGS. 1-6, with no ribs on the side wall 602". The main difference is that it includes elevated 690 and recessed 692 surfaces on the external surface of the bottom 604" of the active insert 600". Such elevated and recessed surfaces contribute to increase the external surface of the bottom of the insert. The active insert 600" also includes a flared upper part 607". The outer surface of the flared upper part forms an angle $\alpha$ of between 135° and 175°, more preferably 170° and 175°. The outer surface of the base of the active insert has a conical bulge 614" with an inclined wall 622".

The container body according to this embodiment (not shown) can be similar to the container body 102 in terms of internal surfaces or internal arrangements (irrespective of any external arrangement with a peripheral flange or not). In particular, the container body comprises, on the lower part of the inner surface of its side wall, 9 axial ribs distributed on the circumference of the inner surface of the side wall of the container body and intended to maintain the lower part of the insert by friction or gripping. The ribs are V-shaped in order to further limit the contact surface between the insert and the container body (as schematically represented in FIG. 9B by elements 190"). The container body also comprises a holding portion including a peripheral protrusion and a peripheral recess below the peripheral protrusion. The peripheral recess is configured to receive the upper extremity 605" of the flared part 607" of the active insert 600" (as can be shown in the embodiment of FIG. 3). Consequently, two peripheral holding portions are provided, the first on the lower part of the active insert 600" (in contact with the 9 longitudinal ribs 190") and the second on the upper extremity 605" of the active insert 600" (snap-fitted below the peripheral protrusion and partially received within the peripheral recess on the inner surface of the side wall of the container body).

Optionally, the inner surface of the base of the container body has a cavity having an inclined wall configured to receive the conical bulge 614" of the base of the active insert (as for example shown in FIG. 2 or FIG. 6).

In this embodiment, a surrounding empty interstice is provided between the two holding portions, such that the air can circulate along the outer periphery of the insert in a direction perpendicular to the axial direction. Such a surrounding empty interstice preferably extends over at least 50%, preferably at least 80% of the length L of the side wall of the active insert.

FIG. 9B shows more particularly the contact surfaces $S_{contact}$ between the outer surface of the active insert 600" and the inner surface of the container body (not shown). These contact surfaces $S_{contact}$ are represented by:

- the contact between the upper extremity 605" of the active insert 600" and the inner surface of the container body (second holding portion): this contact surface has a vertical extension of less than 1 mm, preferably less than 0.5 mm, more preferably less than 0.2 mm;
- the 9 contact lines between the 9 elements 190" on the container body (representing the longitudinal V-shaped ribs distributed around the periphery on the inner surface of the side wall of the container body) and the lower part of the active insert 600" (first holding portion): the ribs extend along less than 50%, preferably less than 20% of the length L of the active insert 600"; and
- optionally, the hatched surfaces on the bottom 604" of the active insert 600": the elevated surfaces 690" can be in contact with the inner surface of the base of the container body.

The remaining surface of the active insert is free from any contact with the container body. In other words, a large proportion of the outer surface of the side wall of the active insert is exposed. In particular, the contact surface $S_{contact}$ between the outer surface of the active insert and the inner surface of the container body is less than 5% of the total surface area of the active insert $S_{insert}$, preferably less than 2%. This allows a better circulation of the air around the outer side of the insert while the insert is maintained immobile within the container body. Surprisingly, Inventors have found that such a reduced contact surface between the active insert and the container body may allow minimizing the thickness and volume of the surrounding empty interstice, without significantly affecting the absorption properties of the active insert. Superior absorption properties may be obtained by the new containers of the invention:

- For a given amount of active material (a given value of Vm), reducing the volume of the empty interstice may allow to increase the inner diameter of the active insert and such, the effective fill volume of the container by simultaneously providing excellent absorption kinetic;
- Similarly, for given effective volume (given inner diameter of the active insert), reducing the volume of the empty interstice may allow to increase the overall absorption capacity (increase Vm) of the desiccant insert.

EXAMPLES

The following example illustrate the invention without limiting it.

Example 1

A study on moisture absorption properties was carried out on containers with the same active insert I (same active material, same weight and same dimensions):

Active insert I: consisting of an active material comprising 35% polystyrene and 65% molecular sieve 4 A. Weight (initial) of the active insert I: 5.9 g.

Container S: container body and active insert I, the container body being over moulded around active insert I. Weight (initial) of the container S: 13.3 g. Container S has no empty interstice between the container body and active insert I. There is no empty interstice between the outer surface of insert I and the inner surface of the container body, the 2 surfaces being in close contact over the whole outer surface of the insert.

Container A: container body and active insert I, the active insert I being moulded separately from the container body and subsequently assembled inside the container body. Weight (initial) of the container A: 11.0 g Container B: container body and active insert I, the active insert I being moulded separately from the container body and subsequently assembled inside the container body. Weight (initial) of the container B: 11.6 g Containers A, B and S are designed to receive a cap connected to the container body by a hinge.

Unlike container S, containers A and B have an empty interstice between the active insert and the container body over at least 50% of the outer surface 609 of the active insert I, allowing the passage of air. Furthermore, both containers A and B have a contact surface $S_{contact}$ between the outer surface of the active insert and the inner surface of the container body of less than 5% of the total surface of the active insert $S_{insert}$, and even less than 2%.

Furthermore, containers A and B have the following parameters:

| Thickness "ei" of the empty interstice (mm): | Container A | Container B |
|---|---|---|
| at the upper extremity of the active insert | 0.04 | 0 |
| at the height of the insert $h_1$ = ¾ L | 0.12 | 0.02 |
| at a height $h_2$ = ½ L | 0.23 | 0.13 |
| at the lower extremity of the active insert | 0.37 | 0.27 |
| $V_m/S_{exp}$ ratio | 0.70 | 0.70 |

The active insert I alone (not assembled on a container body), as well as containers A, B and S, are placed in a climate chamber maintained at 30° C. and 65% RH (relative humidity). Containers A, B and S are tested open, with no cap.

The containers are weighed before being placed in the climate chamber and their mass W(0) is recorded. The containers are then weighed over time t and their mass W(t) is also recorded. The variation in mass DW(t)=W(t)−W(0) represents the quantity of moisture absorbed by the active insert I.

DW(inf) represents the variation in mass in equilibrium, i.e. the maximum quantity of moisture absorbed by the active insert (I) in the climatic conditions of the experiment. DW(inf) is reached when the variation in mass per day is less than 0.05%. That is to say when the following condition is verified for 2 consecutive measurements on days t2 and t1 with t2≥t1+7:

$$\frac{DW(t2) - DW(t1)}{(DW(t2) * (t2 - t1)} < 0{,}05\%$$

Figure 10:
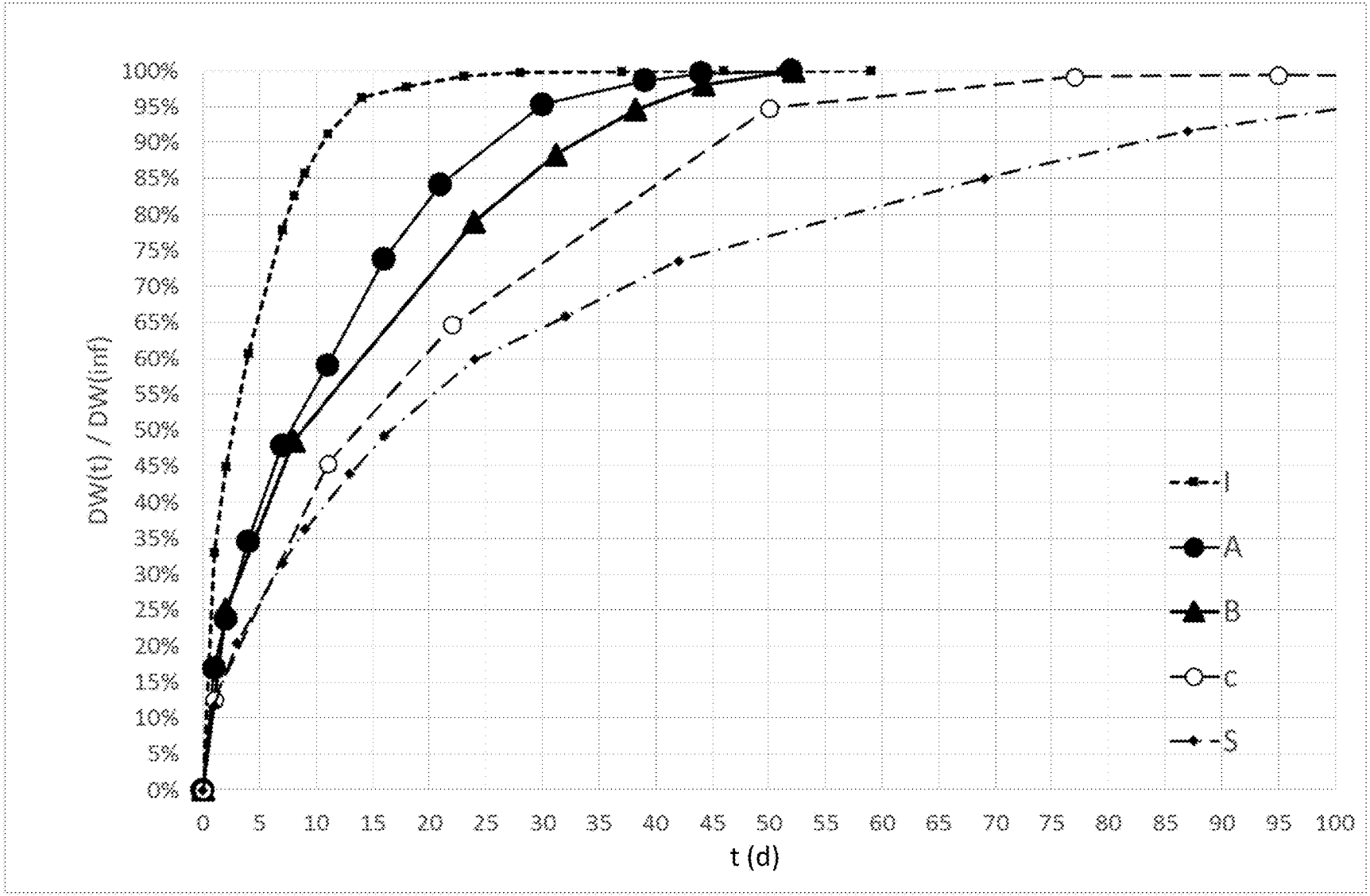
FIG. 10 contains a graph showing the absorption of moisture over time of various containers. The x-axis represents time in days and the y-axis represents variation in the container's weight, in mg, representing the absorption of moisture.

The moisture absorption results are shown in FIG. 10.

The horizontal axis t (d) represents time in days. The vertical axis DW(t)/DW(inf) represents the relative saturation rate of the active insert, i.e. the percentage of the quantity of moisture absorbed by active insert I at moment t in relation to its maximum absorption capacity under the same climatic conditions (30° C., 65% humidity).

The containers in which the active insert has an empty interstice between the active insert and the container body over at least 50% of the outer surface 609 of active insert I absorb moisture more rapidly than the containers that do not have an empty interstice and in which the container body is over moulded around the active insert.

Increasing the gap between the insert and the container body, i.e. increasing the thickness of the empty interstice, did not significantly increase the moisture absorption rate: containers A and B both reached 50% saturation in less than 10 days, while less than 4 days are required for the active insert I alone (not assembled on a container body), and more than 16 days are required for the container S without empty interstice in order to reach this same relative saturation of 50%.

In order to maximise the internal storage volume, a (reduced) thickness of the empty interstice is preferable. Preferably, the thickness of the empty interstice is less than 1 mm, preferably less than 0.5 mm, more preferably less than 0.3 mm.

Example 2

A study on moisture absorption properties was carried out on containers with an active insert made of the same active material but having different dimensions.

Container A: container body and active insert I, active insert I being moulded separately from the container body and subsequently assembled inside the container body.

Active insert I: consisting of an active material comprising 35% polystyrene and 65% molecular sieve 4 A. $V_m/S_{exp}$ ratio=0.70.

Container A is the same container as described in example 1.

Container C: container body and active insert Ic, active insert Ic being moulded separately from the container body and subsequently assembled inside the container body.

Active insert Ic: consisting of an active material comprising 35% polystyrene and 65% molecular sieve 4 A. $V_m/S_{exp}$ ratio=0.86

The two containers A and C have an empty interstice between the active insert and the container body over at least 50% of the outer surface of the active insert, but they have a different $V_m/S_{exp}$ ratio.

As previously (example 1), containers A and C are placed, in the open configuration, with no cap, in a climate chamber maintained at 30° C. and 65% RH (relative humidity). The containers are weighed over time t. Their variation in mass over time represents the quantity of humidity absorbed by their respective active inserts.

The moisture absorption results are shown as previously (example 1) in FIG. 10.

The horizontal axis represents time in days. The vertical axis represents the relative saturation rate of the active insert, i.e. the fraction DW(t)/DW(inf). Moisture absorption is clearly improved for the containers with a $V_m/S_{exp}$ ratio 0.75 (the time to reach 50% of saturation is almost 2 times less for container A than for container C). The containers, in which the active insert has an empty interstice between the active insert and the container body over 50% of the external surface 609, reach 50% of their maximum adsorption capacity in less than 12 days, or even in less than 10 days.

The active inserts tested in this example have an absorption capacity DW(inf) greater than 800 mg, i.e. the containers according to the invention enable the absorption of at least 400 mg of water in less than 12 days, preferably less than 10 days when they are kept in a climate chamber at 30° C. and 65% RH (relative humidity). The containers according to the invention are distinguished by a more rapid moisture absorption.

The invention claimed is:

1. A container for packaging medical and/or pharmaceutical products comprising:

a plastic container body comprising a tubular side wall, a base and an opening defining a storage volume, an active insert, placed inside the container body and including a tubular side wall with length L, extending from a lower extremity to an upper extremity, and an empty interstice between the side wall of the active insert and the side wall of the container body, extending over at least 50% of an outer surface of the side wall of the active insert, wherein the active insert has a $V_m/S_e$ ratio ≤0.75, where $V_m$ is a total material volume of the active insert in $mm^3$, and $S_e$ is a total surface area of the active insert in $mm^2$.

2. The container according to claim 1, wherein the active insert has a $V_m/S_{exp}$ ratio ≤0.75, where $V_m$ is the total material volume of the active insert in $mm^3$, and $S_{exp}$ is a total exposed surface area of the active insert in $mm^2$.

3. The container according to claim 1, in which the empty interstice is surrounding and extends over at least 50% of the length L of the side wall of the active insert.

4. The container according to claim 3, in which the active insert is maintained by two peripheral holding portions.

5. The container according to claim 1, in which a contact surface between the outer surface of the active insert and an inner surface of the container body is less than 5% of a surface area $S_{insert}$, where $S_{insert}$ is a total surface area of all outer surfaces of the active insert whether they are in contact with another surface or freely exposed.

6. The container according to claim 1, wherein the active insert is formed of an active material comprising at least one polymer and at least one active agent capable of interacting with one or more gaseous substances including moisture, oxygen and a volatile organic compound.

7. The container according to claim 1, in which the active insert reaches 50% of its maximum capacity in less than 12 days when the storage volume is subjected to an environment of 65% RH and 30° C.

8. The container according to claim 1, in which the empty interstice has a thickness of at least 0.05 mm, over at least 50% of the length L of the side wall of the active insert.

9. The container according to claim 1, in which the side wall of the active insert includes a flared upper part towards its upper extremity.

10. The container according to claim 1, in which an inner surface of the container body has a holding portion configured to hold the active insert inside the container body, with the holding portion including a peripheral recess and/or a protrusion.

11. The container according to claim 10, in which the holding portion is adjacent to an upper extremity of the active insert.

12. The container according to claim 11, in which an external diameter of the active insert at its upper extremity is greater than an internal diameter of a top of the protrusion.

13. The container according to claim 12, in which, when the active insert is placed inside the container body, the upper extremity of the active insert is arranged below the top of the protrusion.

14. The container according to claim 1, furthermore including a cap closing the opening of the container body, the cap preferably being hinged.

15. The container according to claim 14, wherein the cap is configured to cooperate with the side wall of the container body so as to form an airtight seal.

16. The container according to claim 14, having a moisture penetration rate of less than 1 mg/day at 40° C. and 75% relative humidity.

17. The container according to claim 14, having a moisture penetration rate of less than 10 μg/day/mm seal length at 40° C. and 75% relative humidity.

18. The container according to claim 14, having a moisture penetration rate of less than 375 $mg/mm/m^2/day$ at 40° C. and 75% relative humidity.

19. The container according to claim 14, furthermore including at least one of medical and pharmaceutical products in the storage volume.

20. The container according to claim 1, wherein the empty interstice extends over at least 80% of the outer surface of the side wall of the active insert.

* * * * *